US009074588B2

(12) United States Patent
Khajepour et al.

(10) Patent No.: US 9,074,588 B2
(45) Date of Patent: Jul. 7, 2015

(54) AIR COMPRESSION METHOD AND APPARATUS

(76) Inventors: Amir Khajepour, Waterloo (CA); Amir M. Fazell, Waterloo (CA); Cecile Devaud, Waterloo (CA); Nasser Lashgarian Azad, Kitchener (CA)

( * ) Notice: Subject to any disclaimer, the term of this patent is extended or adjusted under 35 U.S.C. 154(b) by 869 days.

(21) Appl. No.: 13/318,906

(22) PCT Filed: May 6, 2010

(86) PCT No.: PCT/CA2010/000683
§ 371 (c)(1),
(2), (4) Date: Mar. 28, 2012

(87) PCT Pub. No.: WO2010/127446
PCT Pub. Date: Nov. 11, 2010

(65) Prior Publication Data

US 2013/0047595 A1 Feb. 28, 2013

Related U.S. Application Data

(60) Provisional application No. 61/175,999, filed on May 6, 2009.

(51) Int. Cl.
*F04B 27/14* (2006.01)
*F04B 27/067* (2006.01)
*F04C 18/344* (2006.01)

(52) U.S. Cl.
CPC ..... *F04B 27/067* (2013.01); *F04B 27/14* (2013.01); *F04C 18/344* (2013.01)

(58) Field of Classification Search
CPC ..... F04B 27/067; F04B 27/14; F04C 18/344
USPC ..... 60/370, 371; 180/165
See application file for complete search history.

(56) References Cited

U.S. PATENT DOCUMENTS

| | | | | |
|---|---|---|---|---|
| 3,925,984 | A * | 12/1975 | Holleyman | 60/370 |
| 3,958,900 | A * | 5/1976 | Ueno | 417/237 |
| 6,223,846 | B1 * | 5/2001 | Schechter | 180/165 |
| 7,370,630 | B2 * | 5/2008 | Turner et al. | 123/299 |
| 7,789,181 | B1 * | 9/2010 | Schechter | 180/165 |
| 8,657,044 | B2 * | 2/2014 | Donitz et al. | 180/54.1 |

* cited by examiner

*Primary Examiner* — Thomas E Lazo
(74) *Attorney, Agent, or Firm* — Miller Thomson LLP; Tai W. Nahm

(57) ABSTRACT

In a traditional hybrid air engine it is complicated to adjust valve timing to compensate for different engine operating modes. Provided is an air compression method and apparatus. The air compression method can be carried out in a single stage with a plurality of air tanks (61, 63) coupled to a compressor (51). The compressor (51) may be a cylinder Air is added to the compressor (51) at atmospheric pressure. Pressurized air is then added to the compressor (51) from a low pressure air tank (61). The compressor (51) compresses the air and transfers a portion of it to a high pressure air tank (63). The remaining portion of the compressed air is transferred to the low pressure air tank (61) for use in the next compression cycle A cam shaft (27) having a two stroke cam (93) and a four stroke cam (95) for each intake valve (59) and exhaust valve (55, 57) is provided to control valve timing during different operating modes.

19 Claims, 33 Drawing Sheets

PRIOR ART

PRIOR ART

PRIOR ART

PRIOR ART

PRIOR ART

PRIOR ART

AIR COMPRESSION METHOD AND APPARATUS

FIELD OF THE INVENTION

The present invention relates to air compression. The present invention more specifically relates to a method of compressing air using a plurality of air tanks. The invention relates more particularly to an air compression apparatus.

BACKGROUND OF THE INVENTION

There are two types of reciprocating compressors in the market: single stage (shown in FIG. 1) and multi stage compressors (for example the double stage compressor shown in FIG. 2). The working pressure of single stage compressors is limited to under 150 psi. If higher working pressure is required, as in many heavy duty applications, then switching to double or multi stage compressors is inevitable.

FIG. 2 illustrates a typical double stage reciprocating compressor. In double stage compression strategy, the compression process is broken up into two stages. In the first stage, the cylinder receives the fresh air at atmospheric pressure and compresses it using a piston. The compressed air is urged into a low pressure air tank (an intercooler) where some of the heat produced by compression is removed. The air is then channelled to a second cylinder, where it is compressed further to the desired pressure. The air is then channelled to a high pressure air tank for storage. Since the double stage compressors consist of a minimum of two cylinders, they weigh more than single stage compressors. They also have higher energy loss due to the higher piston cylinder friction.

Meanwhile, the automotive industry has seen itself in a marathon of advancement during the last decade. This is partly due to the global environmental concerns on the increase of air pollution and decrease of fossil fuel resources. The next generation of vehicles must be cleaner and more efficient than the current conventional ones. To this end, vehicle manufacturers have tried different innovations: pure electric, fuel cell and hybrid electric vehicles. The pure electric and fuel cell vehicles have not yet proven to be a convenient solution to environmental problems. Compared to conventional vehicles, the traveling range of pure electric vehicles is very low due to the use of batteries, which provide a limited source of energy. On the other hand, it has not yet been possible to commercialize fuel cell technology.

Hybrid electric vehicles have overcome the production limits of pure electric and fuel cell vehicles and are regarded as one of the most effective and feasible solution to environmental concerns. Despite the beneficial improvements that this kind of vehicle provides, there are some serious concerns about their high manufacturing price, complexity and limited battery life.

Typical air hybrid engines operate similarly to typical hybrid electric engines. FIG. 3 illustrates the interconnection between components of a typical air hybrid engine. The air hybrid engine uses two energy sources, fuel and pressurized air. The air hybrid engine absorbs a vehicle's kinetic energy while braking and stores it in the form of compressed air to a storage tank. The compressed air is then used while accelerating. The air is compressed using a single stage compression approach.

FIG. 4 illustrates a cross-sectional view of one example of an air hybrid engine. A typical air hybrid engine has an extra valve per cylinder relative to a traditional four stroke engine, which connects each cylinder to the air tank. During braking, this extra valve opens and the exhaust valve closes, allowing the engine to work as an air compressor, charging the air tank with high pressure air. This pressurized air can later be used to drive the internal combustion engine as an air motor, or it can be used in the combustion process during high energy demand leading to a higher efficiency relative to a fuel-only drive.

Air hybrid engines are typically more efficient than conventional engines because they recover the vehicle's kinetic energy while braking, reduce fuel consumption during a cold start, and enable the engine to work with higher pressure than conventional engines.

A typical air hybrid engine has five modes, namely the compression mode, the air motor mode, air power assisted mode (supercharged) and combustion (conventional) and start up mode.

The compression mode is illustrated in FIG. 5. This mode is activated when the driver applies the brake pedal. In this mode, fuel is shut off and the engine works as a two stroke air compressor and the piston compresses the air into the air tank while the exhaust valve remains deactivated, storing the vehicle's kinetic energy in the shape of pressurized air in the air tank.

The air motor mode is shown in the FIG. 6. The valve between the air tank and the cylinder opens, allowing the pressurized air to run the engine as a two stroke air motor. This mode is activated when the power demand is low or at cold start to avoid high fuel consumption.

The air power assisted mode (supercharged) is shown in FIG. 7 and is activated when the desired torque is high. The intake valve is deactivated and pressurized air is delivered from the air tank leading to a more efficient combustion process in the cylinder. The engine is provided with pressurized air from the air tank instead of from the atmosphere. The mass of fuel and air entering the engine cylinders is increased, which in turn increases the produced power significantly in this mode. In contrast to typical supercharged engines which have lower efficiency at low speeds and loads, air hybrid engines can be supercharged at any operating point thanks to stored air in the air tank. Conventional mode is also activated when the desired load is moderate or the air tank pressure is relatively low or empty. The stored air in the air tank can also be used to run the engine at cold start. This mode is the start up mode.

In the combustion mode, the air tank valve is closed while the intake and exhaust valves are used for enabling driving of the engine as a typical four stroke engine.

As is commonly known, in typical city driving (where stop and go driving is common) a significant fraction of energy is consumed in braking. For instance, in EPA FTP75 urban driving cycle approximately 40% of the energy is wasted while braking. Thus, if the braking system can recover the braking energy, the vehicle energy consumption will be reduced significantly. Air hybrid engines have been developed to capture and store the braking energy for further use.

The ideal air cycle of the single tank system is shown in FIG. 8. When the piston is at the Bottom Dead Center (BDC), the intake valve closes. The piston starts moving up to the Top Dead Center (TDC) and compresses the air adiabatically.

The charging valve opens when the air pressure in the cylinder equals the tank pressure. At this time, air enters the tank in a constant pressure process, assuming that the air tank is big enough and its pressure does not change while charging. The charging valve closes when the piston is at TDC. The piston moves down and the intake valve opens when the pressure in the cylinder equals the atmospheric pressure. The aforementioned cycle is the ideal cycle and has the highest stored air mass in the air tank to the consumed energy ratio comparing to any other cycle.

The maximum amount of air mass that can be stored in the air tank is limited, based on the following relation:

$$m_{max} = C_r \frac{P_{atm}}{T_{atm} R} V_{tank} M, \tag{1}$$

where R is the ideal gas constant, $V_{tank}$ is the air tank volume, M is the air molecular mass, and $C_r$ is the cylinder compression ratio. Setting the maximum allowable temperature of the air tank, its maximum pressure also can be defined based on the above equation. By increasing the cylinder compression ratio, the capacity of energy storing can be increased, however this will result in higher temperature which deteriorates the efficiency of the system.

The above relation can be proven with reference to FIG. 8. Suppose that the air tank is already full and its pressure and temperature are $P_{tank}$ and $T_{tank}$. Air tank pressure and temperature are related based on equation (1), by the following relation:

$$P_{tank} = \frac{P_{atm} T_{tank}}{T_{atm}} C_r \tag{2}$$

At point 1, the air mass inside the cylinder is:

$$m_1 = \frac{P_{atm} V_{cyl}}{R T_{atm}} M \tag{3}$$

Considering adiabatic compression and ideal mixing of gases, cylinder pressure at the arbitrary point 2 is:

$$P_2 = \frac{P_{atm}\left(\frac{V_{cyl}}{V^*}\right)^k V^* + \frac{P_{atm} T_{tank}}{T_{atm}} V_{tank} C_r}{V^* + V_{tank}} \tag{4}$$

and the temperature at point 2 is $$T_2 = \frac{P_{atm}\left(\frac{V_{cyl}}{V^*}\right)^k V^* + \frac{P_{atm} T_{tank}}{T_{atm}} V_{tank} C_r}{\frac{P_{atm}\left(\frac{V_{cyl}}{V^*}\right)^k V^*}{T_{atm}\left(\frac{V_{cyl}}{V^*}\right)^{k-1}} + \frac{P_{atm}}{T_{atm}} V_{tank} C_r} \tag{5}$$

Air pressure and temperature at point 3 are defined by equations (6) and (7).

$$P_3 = P_2\left(\frac{V_{tank} + V^*}{V_{tank} + \frac{V_{cyl}}{C_r}}\right)^k \tag{6}$$

$$T_3 = T_2\left(\frac{V_{tank} + V^*}{V_{tank} + \frac{V_{cyl}}{C_r}}\right)^{k-1} \tag{7}$$

The charging valve closes at point 3 so the amount of air mass trapped in the cylinder dead volume can be found as follows:

$$m_{trapped} = \frac{P_3 \frac{V_{cyl}}{C_r}}{R T_3} M \tag{8}$$

By plugging equations (6) and (7) into equation (8), the trapped mass in the cylinder dead volume becomes:

$$m_{trapped} = \frac{P_{atm} V_{cyl}}{R T_{atm}} M \tag{9}$$

equaling the amount of air mass entered into the cylinder at point '1'. This proves that the maximum amount of air mass in the air tank is limited by equation (1).

The above mentioned braking cycle can be used to model regenerative braking, as illustrated in FIG. 9 of a typical air hybrid engine vehicle with the specification shown in Table 1, which models a 1400 kg vehicle decelerating from 90 km/hr to 10 km/hr using only regenerative braking.

TABLE 1

| | | |
|---|---|---|
| Vehicle Mass | 1400 | kg |
| Vehicle Initial Velocity | 90 | km/hr |
| Vehicle Final Velocity | 10 | km/hr |
| Transmition Ratio | 5.7 | |
| Cylinder Volume | 2 | L |
| Air Tank Volume | 30 | L |
| Air Tank Temperature | 750 | K |
| Air Tank Initial Pressure | 1 | bar |
| Compression Ratio | 10 | |

FIG. 10 illustrates the pressure profile in the air tank versus time for a typical air hybrid engine implementation. As can be seen, the pressure in the storage increases but there is a limit for the pressure in the air tank. In a particular implementation, the pressure in the air tank builds up to 25 bar but it cannot go further beyond this value. Furthermore, the efficiency of regenerative braking is limited in this implementation to about 22% and the braking time (using only regenerative braking) is about 17.1 s.

Capturing 22% of the vehicle's kinetic energy is significant, however storage could be improved to enhance efficiency. There are two options to increase the capacity of energy storing in the air tank, either using a higher volume tank or increasing the pressure. Increasing the volume of the tank is not a viable solution due to the lack of the space in the vehicle. On the other hand, increasing the pressure is not achievable in current air hybrids because, the maximum pressure is limited by the engine compression ratio.

Furthermore, in contrast with conventional engines which have only one mode of operation (combustion), air hybrid engines have five modes of operation as described above. At each mode, a different type of cycle should be followed, with each cycle having different valve timing. Thus a camless valvetrain is typically required for air hybrid engine control.

A conventional valvetrain limits the performance of an engine but has more operational advantages over a camless valvetrain because valve motion is governed by the cam profile, which is typically designed to have low seating velocity. Seating velocity in the camshaft design is limited below 0.5 m/s. The valve's low seating velocity leads to durability and low noise. In contrast, a typical camless valvetrain, which has no mechanical connection with engine, introduces a difficult control problem. Control techniques should be applied to perform both accurate valve timing and low seating velocity [4, 7]. This introduces a very complicated problem, especially in the case of an air hybrid engine, in which the valve timing changes to compensate for different desired loads. The controller therefore must be robust enough to account for engine speed, tank pressure and desired torque variations.

What is required, therefore, is a method for more optimally compressing air. What is also required is an air hybrid engine operable to more optimally compress air than current air hybrid engines. A more optimal camless valvetrain would also be beneficial for controlling air hybrid engines.

SUMMARY OF THE INVENTION

The present invention relates to air compression, and more specifically relates to a method of compressing air using an air compression apparatus with a plurality of air tanks. In an aspect, there is provided a method of compressing air, the method characterized by: (a) adding air to a compressor at a first pressure from an air intake valve; (b) adding air to the compressor at a second pressure greater than the first pressure from a first air tank; (c) adiabatically compressing the air in the compressor; (d) transferring a portion of the compressed air to a second air tank; and (e) transferring the remaining portion of the compressed air tank to the first air tank.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION

Figure 1:
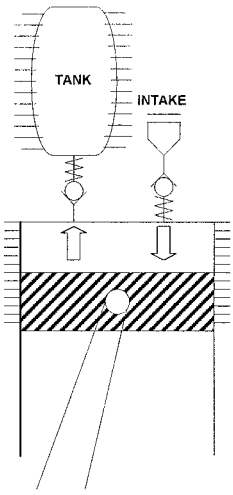
FIG. 1 PRIOR ART
FIG. 1 illustrates a typical double stage reciprocating compressor.
Figure 2:
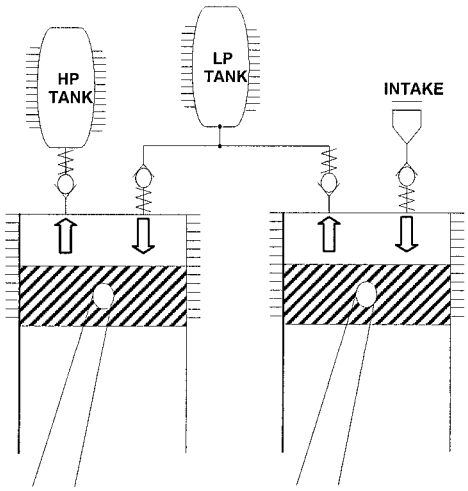
FIG. 2 illustrates a typical double stage compressor.
Figure 3:
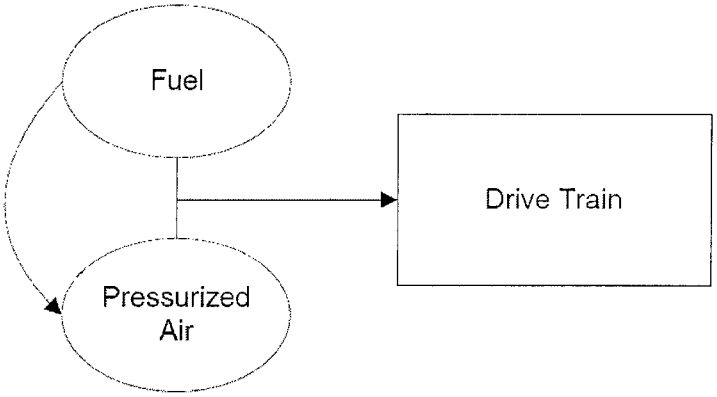
FIG. 3 PRIOR ART
FIG. 3 illustrates the interconnection between components of a typical air hybrid engine.
Figure 4:
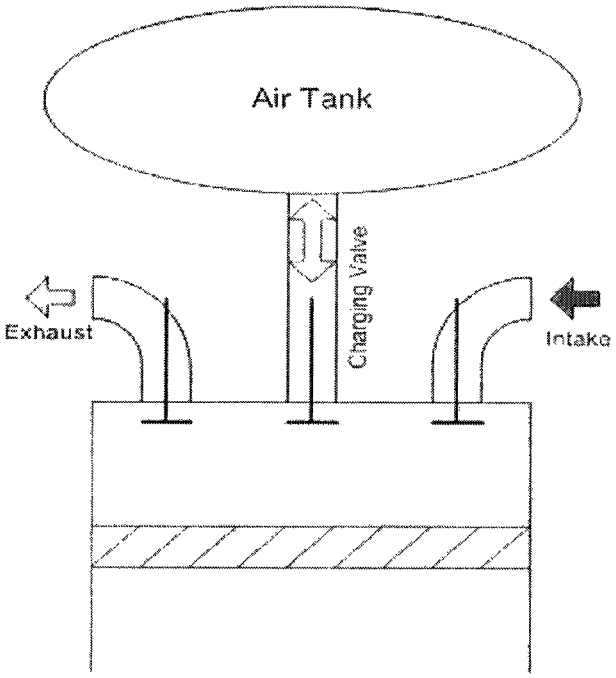
FIG. 4 illustrates a cross-sectional view of one example of an air hybrid engine.

The present invention provides a single stage, double tank method of compressing air. The method requires compression of air by only one stage and as few as one cylinder, using a plurality of air tanks. The method comprises: (i) adding air to the cylinder at a first pressure, for example atmospheric pressure, from an air intake valve; (ii) adding air to the cylinder at a second pressure greater than the first pressure from a first air tank, for example a low pressure air tank; (iii) adiabatically compressing the air in the cylinder, for example by moving its piston toward top-dead-centre, (iv) transferring a portion of the compressed air to a second air tank, for example a high pressure air tank; and (v) transferring the remaining portion of the compressed air to the first air tank. The method can be repeated for further air compression in the second air tank.

The air compression method provided by the present invention can be implemented in an air hybrid engine, a reciprocal compressor, a Vane compressor. In an air hybrid engine, the method can be used in compression mode. The air compressed using the air compression method of the present invention can be also used to power an air powered device, including an air motor, air hybrid engine, a pneumatic tool, etc.

The present invention provides an air hybrid engine having a plurality of air tanks. The plurality of air tanks includes at least one low pressure air tank and a high pressure air tank. The use of the at least one low pressure air tank enables the high pressure air tank to achieve additional air pressure per engine cycle when the engine is in compression mode as compared to the prior art. The use of two air tanks can be shown to enhance the amount of a vehicle's kinetic energy to be captured and stored during braking (in compression mode) and to be used later (for example, in air motor mode, air power assisted mode (supercharged), start up mode, or for powering accessories).

In one example implementation of the present invention, an air hybrid engine comprises an intake manifold, an exhaust manifold, a low pressure air tank, a high pressure air tank, a plurality of cylinders, and a cam shaft.

Each cylinder generally has a piston, a first and second intake valve, and a first and second exhaust valve. The first intake valve selectively enables air flow (i) between the intake manifold and the cylinder or (ii) from the cylinder to the high pressure air tank. The second intake valve selectively enables air flow (i) from the intake to the cylinder or (ii) from the high pressure air tank to the cylinder. The first exhaust valve selectively enables air flow (i) between the exhaust manifold and the cylinder or (ii) from the cylinder to the low pressure air tank. The second exhaust valve selectively enables air flow (i) from the low pressure air tank to the cylinder or (ii) between the exhaust manifold and the cylinder. One way air flow may be implemented by adapting a directional air flow regulator along the air flow path to be regulated. The directional air flow regulator may, for example, be a check valve.

The cam shaft is provided with both a two stroke cam and a four stroke cam for each intake valve and exhaust valve. The cam shaft is movable from a first position coupling the two stroke cams to the intake valves and exhaust valves and a second position coupling the four stroke cams to the intake valves and exhaust valves. By moving the cam shaft as appropriate for the engine mode in operation, the air hybrid engine selectively charges, discharges and stores air in the low pressure air tank and high pressure air tank.

In another example implementation of the present invention, an air hybrid engine comprises an intake manifold, an exhaust manifold, at least one low pressure air tank, a high pressure air tank and a plurality of cylinders. The air hybrid engine may have a camless valvetrain with flexible timing at different modes of engine operation.

Each cylinder has a piston and two or more valves for selectively enabling air flow between the cylinder and the intake manifold, exhaust manifold, the at least one low pressure air tank and the high pressure air tank for selectively charging, discharging and storing air in the low pressure air tank and high pressure air tank. The selective enablement of air flow is described more fully below.

The means for selectively enabling air flow between the cylinder and the manifolds/air tanks can be provided by intake, exhaust, low pressure air tank, and high pressure air tank valves disposed on the cylinder. It could also be provided by disposing two intake and two exhaust valves on the cylinder, a three-way valve connected to each of the intake valves permitting air flow therebetween, and two more three-way valves connected to each of the exhaust valves permitting air flow therebetween. Each of the three-way valves connected to the intake valves is further connected to both the high pressure air tank and the intake manifold for selectively permitting air flow therebetween. Each of the three-way valves connected to the exhaust valves is further connected to both the low pressure air tank and the exhaust manifold for selectively permitting air flow therebetween. The three-way valves can be controlled by a timing means, such as a solenoid, for selectively permitting air flow between the manifolds/air tanks and the valves based on the engine mode in operation. In the latter implementation, the air hybrid engine can be adapted to an existing four cylinder engine having two intake and two exhaust valves.

The present invention also provides a multi-tank technique for using the stored, compressed air in an air hybrid engine.

The present invention also provides a means for driving a vehicle's engine accessories for example by means of an air motor connected to the high pressure tank to which accessories are connected.

The single stage, double tank method of compressing air can be applied to typical reciprocating compressors. This enables the present invention to provide the advantages of double stage compression (higher output pressure and flow rate compared to the single tank compression) while requiring similar energy consumption, lower weight and lower friction compared to a typical double stage compressors.

Figure 11:
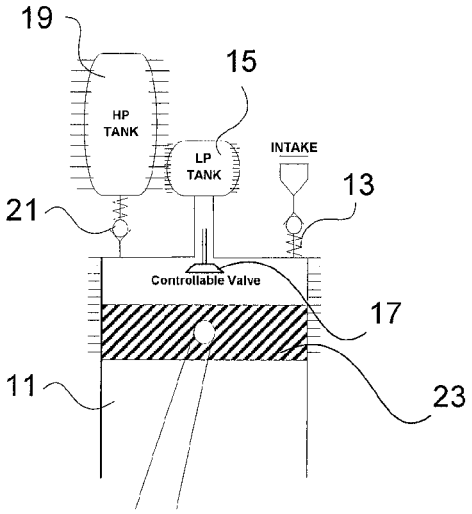
FIG. 11 illustrates a double tank compressor with which the method of the present invention is operable.

FIG. 11 illustrates a double tank compressor with which the method of the present invention is operable. The compressor includes a single cylinder 11, an air intake valve 13, a low pressure air tank (LP) 15 connected by a LP valve 17 and a high pressure air tank (HP) 19 connected by a HP valve 21. The LP 15 may be similar in size as in prior art double stage compressors, and is operable to provide intercooling. The LP valve 17 could be either fully flexible valve as shown in FIG. 11, such as an electro-hydraulic or electromagnetic valve, or it can be cam-based valve as shown in FIG. 12.

Directional air flow regulators, such as check valves, may be provided for enabling air flow only from the intake to the cylinder and not vice versa, and only from the cylinder to the HP and not vice versa.

Figure 12:
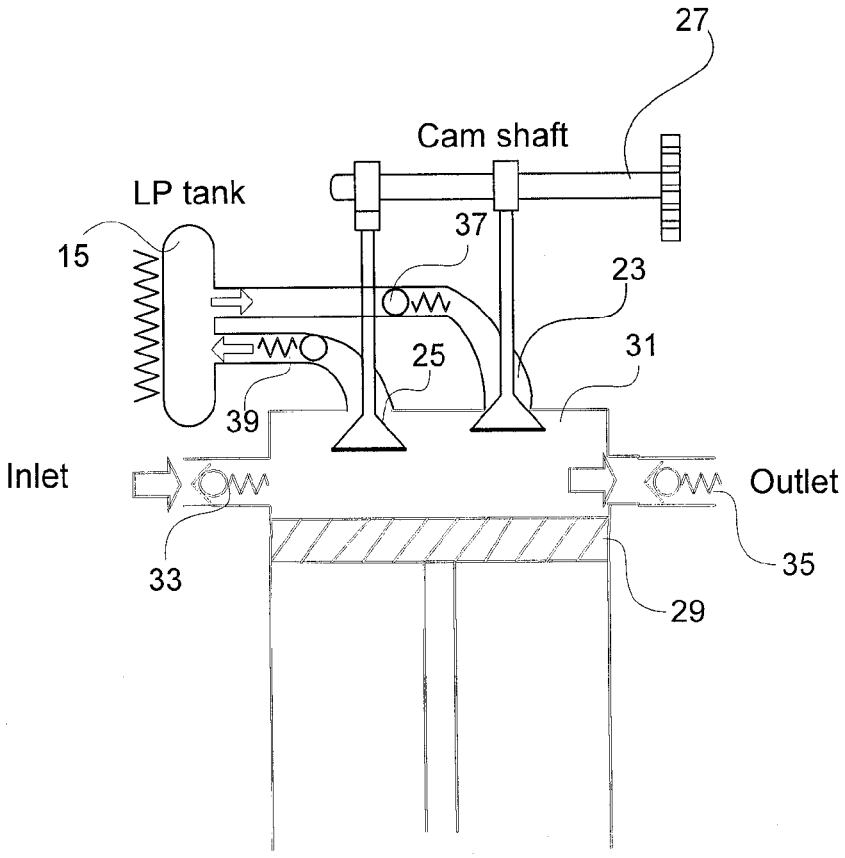
FIG. 12 illustrates a reciprocating double tank compressor with cam-based valves '1' and '2'.
Figure 13:
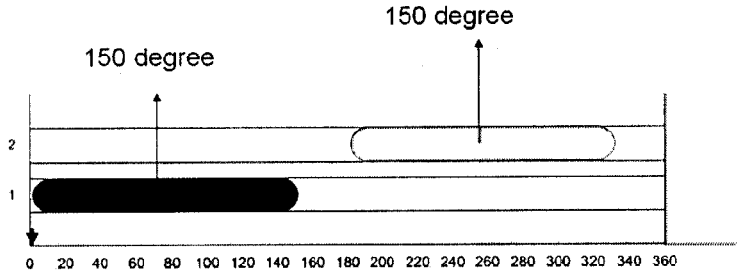
FIG. 13 illustrates valve timing for valves '1' and '2'.

FIG. 12 illustrates a reciprocating double tank compressor with cam-based valves 23 and 25. FIG. 13 illustrates valve timing for valves 23 and 25. Cam-based valves 23 and 25 may be coupled to a crank shaft through the cam shaft 27. Each valve may be open for at least 150° of Cam Angle Degree (CAD). Note that the timings shown in FIG. 13 are approximate and may be optimized for the particular application.

As the piston 29 moves down, both LP valves are closed and atmospheric fresh air fills the cylinder 31 through the intake check valve 33. When the piston is at BDC, valve 23 is opened and more air enters the cylinder if the LP tank pressure is higher than the cylinder pressure. Air is prevented from exiting the cylinder by intake check valve 33 and exhaust check valve 35. When the piston begins to move up, the air in the cylinder compresses adiabatically. Once the pressure in the cylinder reaches the pressure of the LP valve, the check valve 37 closes, preventing air flow from the cylinder to the LP 15 through valve 23. Once the pressure in the cylinder exceeds the pressure in the HP 19 (shown in FIG. 12), the HP check valve 21 is opened. The HP 19 is charged by the pressurized air in the cylinder 11 until the cam-based valve 25 is opened. After opening of valve 25, the LP 15 is charged by the remaining of the pressurized air in the cylinder 11 and the HP check valve 21 is closed because the cylinder pressure drops below the HP pressure. Valve 23 may be open for at least 150° of CAD, however there may be flow between LP 15 and the cylinder 11 if and only if the pressure in the cylinder 11 is higher than the LP pressure. The cylinder pressure drops as soon as the piston 29 starts moving down and air flow from the LP 15 to the cylinder 11 is prevented by the check valve 39.

The single stage, double tank method of compressing air in accordance with the present invention can be shown to be advantageous over prior art methods. Tables 2, 3 and 4 show characteristics of simulated prior art single stage, prior art double stage and single stage double tank compressors (in accordance with the present invention). As can be seen, all of the compressors have the same cylinder characteristics. The second cylinder of the double stage compressor is chosen relative to the characteristic of the first cylinder. The outlet pressure is set at 13 bar.

TABLE 2

| Single stage compressor | |
|---|---|
| Displacement volume | 278 cc |
| Dead volume | 30 cc |
| Compressor speed | 3000 rpm |
| Tank volume | 30 l |

TABLE 3

| Double stage compressor | |
|---|---|
| $1^{st}$ chamber displacement volume | 278 cc |
| $1^{st}$ chamber dead volume | 30 cc |
| $2^{nd}$ chamber displacement volume | 84 cc |
| $2^{nd}$ chamber dead volume | 10 cc |
| Tank volume | 30 l |
| Intercooler volume | 1 l |

TABLE 4

| Double tank compressor | |
|---|---|
| Displacement volume | 278 cc |
| Dead volume | 30 cc |
| Compressor speed | 3000 rpm |
| Tank volume | 30 l |
| Auxiliary tank volume | 1 l |

Notably, the excessive friction of double stage compressor due to having double piston-cylinder friction is not included in the simulations. Thus, the simulated energy consumption of the double stage compressor is underestimated and its actual energy consumption is closed to that of a double tank compressor.

Figure 14:
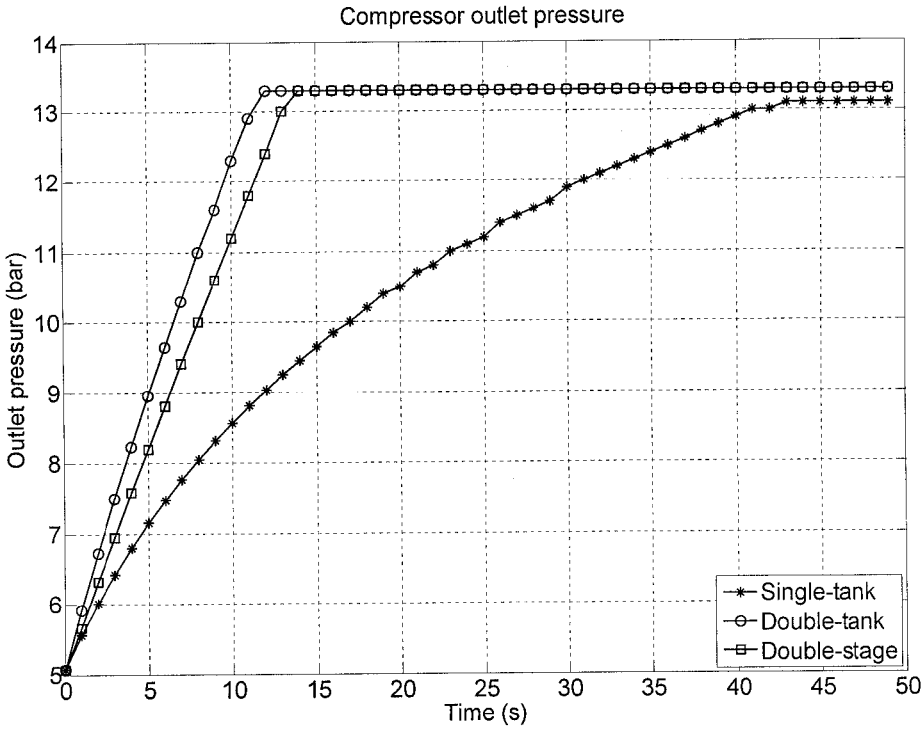
FIG. 14 illustrates the outlet pressure of each of the compressors.

FIG. 14 illustrates the outlet pressure of each of the compressors. As can be seen, double stage and double tank compressors reach to their maximum working pressure at substantially the same time. However, it takes much longer time for the single tank compressor to reach to the working pressure. Thus, the single stage, double tank compressor is operable to provide similar compression capability as the prior art double stage compressor with significant savings in size, weight and cost.

Figure 15:
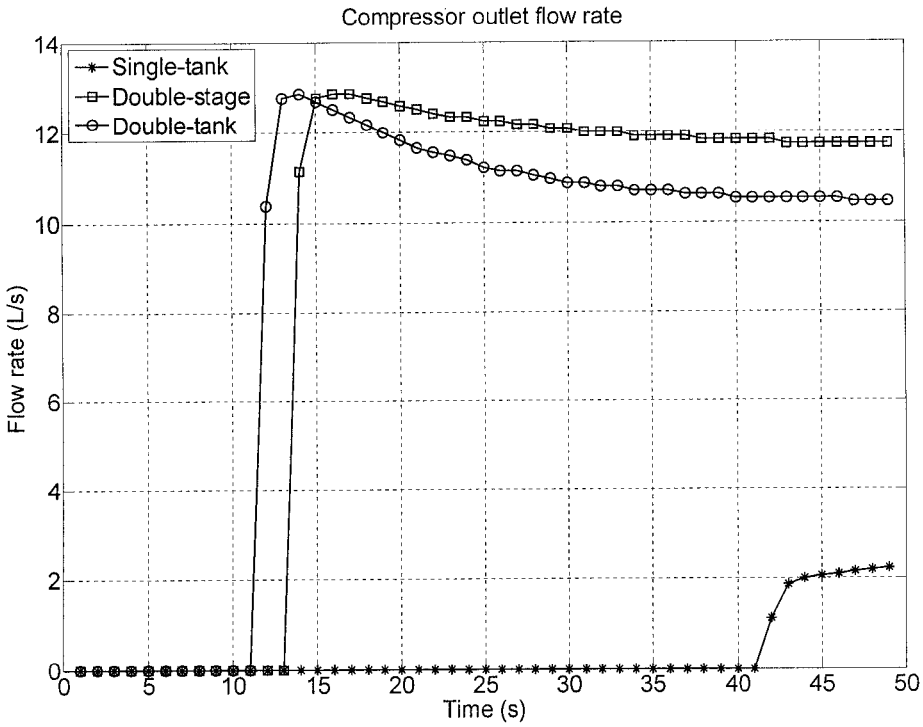
FIG. 15 illustrates the outlet flow rate of each of the compressors.

FIG. 15 illustrates the outlet flow rate of each of the compressors. As can be seen, the double tank and double stage compressors have substantially the same outlet flow rate. However, the outlet flow rate of a single tank system is not comparable to neither of the double stage and double tank compressors.

Figure 16:
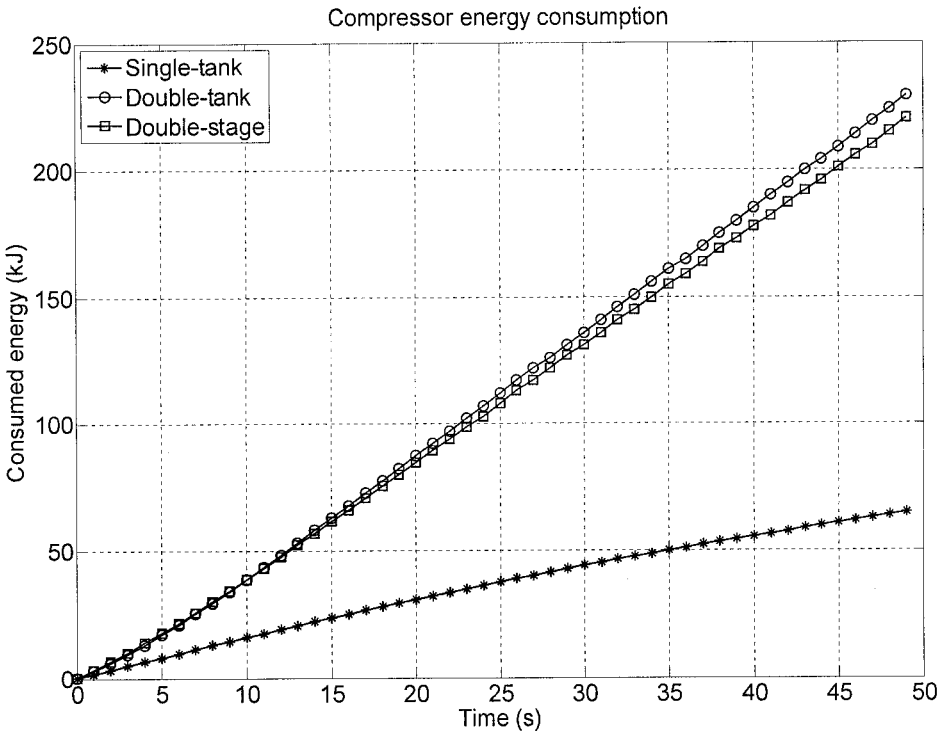
FIG. 16 illustrates the consumed energy for each of the compressors.

FIG. 16 illustrates the consumed energy for each of the compressors. As can be seen, double stage and double tank compressors have substantially the same energy consumption.

The results obtained by the simulations and experiments show that the double tank compressors have the almost the same performance as the double stage compressors in terms of outlet pressure, flow rate and energy consumption with half of the weight and complexity. This introduces a significant advantage for the double tank compressors compared to the double stage compressors, especially for industrial reciprocating compressors where the compressor price is a function of its weight.

Thus the compression system having a plurality of air tanks provides several advantages over the multistage compressor of the prior art. For example, there is no need for an extra cylinder which reduces the space required for the compressor and associated mechanical linkages. The use of a single cylinder also reduces the compressor friction and leads to higher efficiency. The use of a single cylinder cycle instead of two or more cycles also increases efficiency. Furthermore, piping may be significantly reduced over the multistage compressor. An air compressor in accordance with the present invention provides increased pressure with less parts and therefore less cost than prior art air compressors.

It should also be noted that the compression system having a plurality of air tanks is operable with either fixed or variable valve timing.

Figure 17:
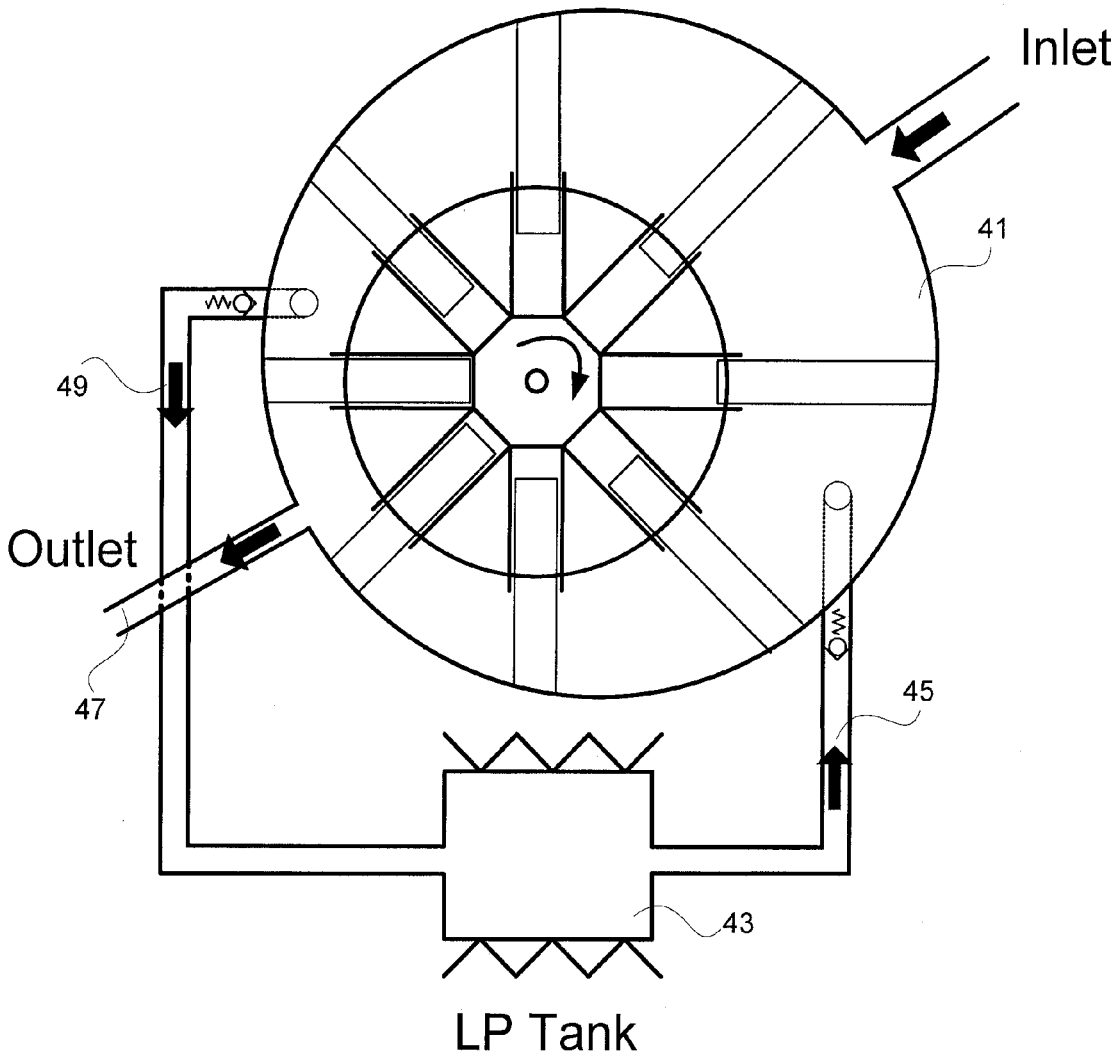
FIG. 17 illustrates implementation of a single stage double tank compression in a Vane type rotary compressor.

The single stage double tank compression method can also be implemented in a Vane type rotary compressor. FIG. 17 illustrates implementation of a single stage double tank compression in a Vane type rotary compressor. In this type of compressor, atmospheric air enters the largest compartment 41 of the vane housing. As the vane shaft rotates, the compartment becomes disconnected from the inlet and connected to the LP 43. Thus, the pressure in the compartment 41 increases not only because of the vane shaft rotation, but also because of the air flow 45 from the LP to the compartment. As the vane shaft rotates, the size of the compartment gets smaller and smaller and ultimately, the compartment gets connected to the compressor outlet 47. After passing the outlet 47, there is still enough pressure in the compartment to charge 49 the LP 43 as shown in FIG. 17. In order to increase the efficiency of the process, LP tank could be cooled down either by air or liquid coolant.

The air compression method provided by the present invention can be implemented in an air hybrid engine.

In accordance with the present invention, in one aspect thereof, an air hybrid engine apparatus having a plurality of air storage tanks is provided for increasing the storing pressure among the air tanks. For example, two air tanks may be provided, one low pressure air tank (LP) and one high pressure air tank (HP).

FIGS. 18 to 22 illustrate a cylinder of an air hybrid engine connected to a low pressure air tank and a high pressure air tank in accordance with the present invention. FIGS. 8 to 22 illustrate in particular the air hybrid engine operating in compression mode for charging the LP and HP with pressurized air.

The cylinder 51 has a piston 53, an intake valve 59, a low pressure air tank valve 55 and a high pressure air tank valve 57. Air to the intake, the low pressure air tank and the high pressure air tank may be connected to the valves by connecting means permitting air flow therebetween. The connecting means may be tubes, pipes or manifolds. It should be noted that the typical air and fuel supplies and an exhaust system, as well as other parts, may be connected to the engine apparatus and are not shown.

In the example wherein two storage tanks are provided, each cylinder of the engine may have a plurality of valves, including an intake valve 59 for receiving an air/fuel mixture, an exhaust valve (not shown) for expelling exhaust, a LP valve 55 for transferring gases between the cylinder 51 and LP 61, and a HP valve 57 for transferring gases between the cylinder 51 and HP 63. The LP 61 and the HP 63 may be linked to the LP valve 55 and HP valve 57 respectively, by the connecting means such as tubes, pipes, or manifolds mentioned above.

The plurality of storage tanks may be used in accordance with a regenerative braking procedure in compression mode. The following description illustrates the regenerative braking procedure in five stages occurring in one rotation of an engine with one cylinder, but it should be understood that the same could be used for each cylinder in the engine apparatus and that the cycle would repeat for each subsequent cycle.

Figures 18, 19, 20, 21, 22:
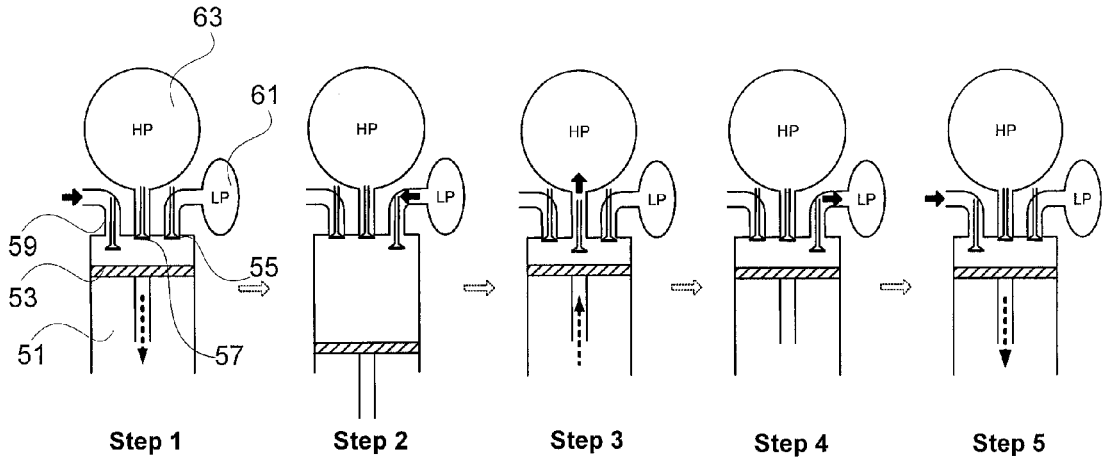
FIG. 18 illustrates the first stage of the method provided by the present invention, in one aspect thereof.
FIG. 19 illustrates the second stage of the method provided by the present invention, in one aspect thereof.
FIG. 20 illustrates the third stage of the method provided by the present invention, in one aspect thereof.
FIG. 21 illustrates the fourth stage of the method provided by the present invention, in one aspect thereof.
FIG. 22 illustrates the fifth stage of the method provided by the present invention, in one aspect thereof.

FIG. 18 illustrates the first stage of compression mode. In this stage, the intake valve 59 opens and the cylinder 51 is filled with atmospheric pressure.

FIG. 19 illustrates the second stage. In this stage, the intake valve 59 closes and the LP valve 55 opens and after a while closes. In this way, the cylinder 51 is charged with the air from LP 61. Thus, the cylinder pressure can go higher than atmospheric pressure.

FIG. 20 illustrates the third stage. In this stage, gas in the cylinder 51 is compressed adiabatically by the upward movement of the piston 53, and the HP valve 57 opens enabling the HP 63 to charge adiabatically, and then closes after a while.

FIG. 21 illustrates the fourth stage. In this stage, the LP valve 55 opens enabling the LP 61 to be charged adiabatically with the residue of the pressurized air in the cylinder 51, and the LP valve 55 closes after a while.

FIG. 22 illustrates the fifth stage. In this step, the piston 53 returns to the BDC and the intake valve 59 opens so that the cylinder 51 is filled by atmospheric pressure.

The above approach will result in a higher pressure in the main tank (HP 63) compared to conventional single tank system because the cylinder pressure is higher than atmospheric pressure when the piston is at BDC at each revolution. This pressurized air will be a source of energy to accelerate the car using the engine as an air motor, or to supercharge the engine in low speed to improve overall efficiency and reduce emissions. The pressurized air can also be used in further applications as explained more fully below.

Furthermore, both the LP and HP are charged in one revolution of the crank shaft. It is noteworthy that the compression method of the present invention is different from multi-stage compression since it only needs one cylinder, and it happens in just one revolution of the crank shaft.

Figure 23:
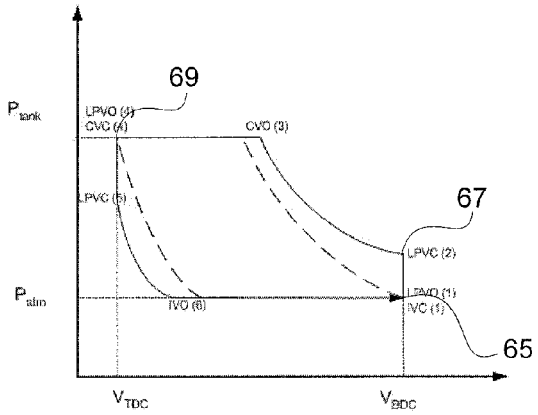
FIG. 23 illustrates the sixth stage of the method provided by the present invention, in one aspect thereof.

FIG. 23 illustrates a thermodynamics cycle of an air hybrid engine in compression mode in accordance with the present invention. This thermodynamic cycle can be contrasted with that shown in FIG. 8.

The maximum theoretical amount of air mass that can be stored in a double tank regenerative system in accordance with the present invention is:

$$m_{max} = \frac{P_{atm} V_{tank}}{T_{atm} R} C_r \left( \frac{1 + C_r \cdot \frac{V_{LP}}{V_{cyl}}}{1 + \frac{V_{LP}}{V_{cyl}}} \right) M \tag{10}$$

where $V_{cyl}$ is the cylinder volume, $V_{LP}$ is the LP volume, and $T_{atm}$ is the atmospheric temperature. The maximum pressure of the main storage (HP) could be defined based on the above equation by setting the maximum allowable temperature, $T_{HP,max}$ of HP. Considering $$\frac{T_{HP,max}}{T_{atm}} = 2.5, \ \frac{V_{LP}}{V_{cyl}} = 1$$

and $C_r$=10, the maximum pressure could go up to 137.5 bar, which is a sizeable improvement compared to 25 bar. Consequently, the aforementioned two storage tanks can increase the stored energy by a factor of 5.

Equation 10 can be proven with reference to FIG. 23. Air pressure and temperature may be considered to be atmospheric pressure and temperature at point 65. The maximum amount of mass stored in the LP tank based on the above discussion is:

$$m_{LP} = \frac{P_{atm}V_{LP}}{RT_{atm}}C_r M \tag{11}$$

To maximize the efficiency of energy storing, the LP tank should be cooled down. By setting the LP temperature at atmospheric temperature, the maximum LP pressure is defined based on equation (1) by the following relation:

$$P_{LP}=P_{atm}C_r \tag{12}$$

Assuming ideal gas mixing, pressure at point 67 is:

$$P_2 = \frac{P_{atm}V_{cyl} + P_{LP}V_{LP}}{V_{cyl} + V_{LP}} \tag{13}$$

Without loss of generality, the charging valve can be assumed to open and close precisely at TDC. Thus, pressure and temperature at point 69 will be defined by equations (14) and (15):

$$P_{3,4} = \frac{P_{atm}V_{cyl} + P_{LP}V_{LP}}{V_{cyl} + V_{LP}}C_r^k \tag{14}$$

$$T_{3,4} = T_{atm}C_r^{k-1} \tag{15}$$

Equation (14) expresses the maximum pressure of the air in the cylinder. Considering an ideal gas mixing process and heat transfer, the maximum pressure in the HP tank can be expressed by the following relation:

$$\begin{aligned} P_{HP,max} &= \frac{P_4}{T_4}T_{HP,max} \\ &= P_{atm}\frac{T_{HP}}{T_{atm}}C_r\left(\frac{C_rV_{LP} + V_{cyl}}{V_{LP} + V_{cyl}}\right) \end{aligned} \tag{16}$$

The maximum amount of mass stored in HP is also defined by equation (17):

$$\begin{aligned} m_{HP,max} &= \frac{P_{HP,max}V_{HP}}{RT_{HP,max}}M \\ &= P_{atm}\frac{V_{HP}}{RT_{atm}}C_r\left(\frac{C_rV_{LP} + V_{cyl}}{V_{LP} + V_{cyl}}\right)M \end{aligned} \tag{17}$$

The above system can be shown to increase the compression achievable using two tanks instead of one. Table 5 illustrates example vehicle specification for use in a simulation.

TABLE 5

| | |
|---|---|
| Vehicle Mass | 1400 kg |
| Vehicle Initial Velocity | 90 km/hr |
| Vehicle Final Velocity | 10 km/hr |
| Transmission Ratio | 5.7 |
| Cylinder Volume | 2 L |

TABLE 5-continued

| | |
|---|---|
| HP Volume | 30 L |
| LP Volume | 2 L |
| Air Tank Temperature | 750 K |
| Air Tank Initial Pressure | 1 bar |
| Compression Ratio | 10 |

Figure 24:
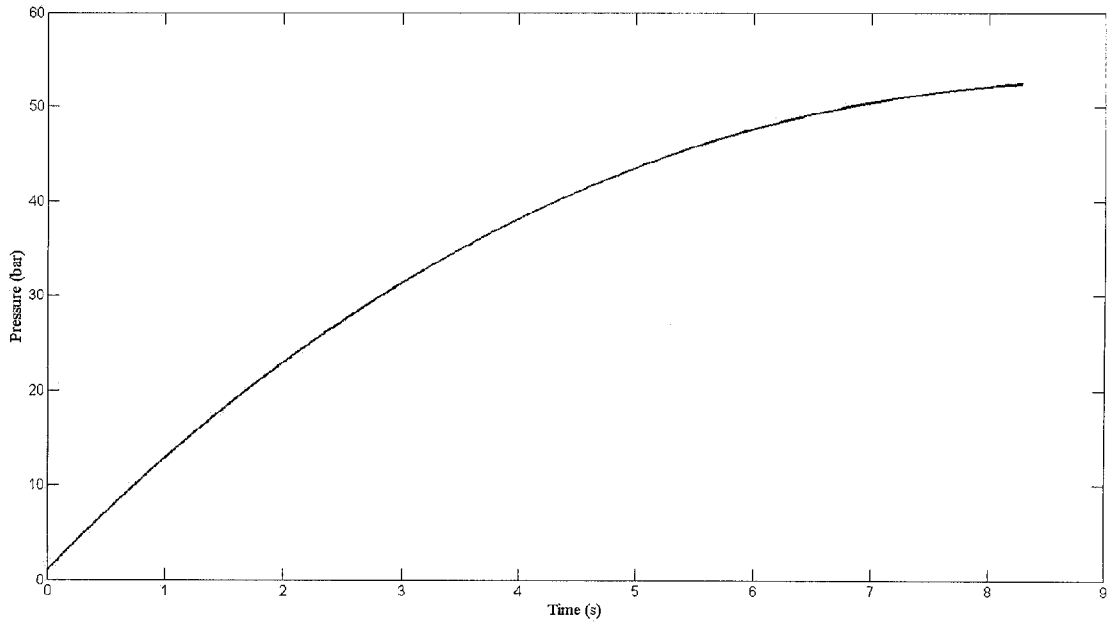
FIG. 24 illustrates the pressure in the HP in a particular implementation of the present invention.
Figure 25:
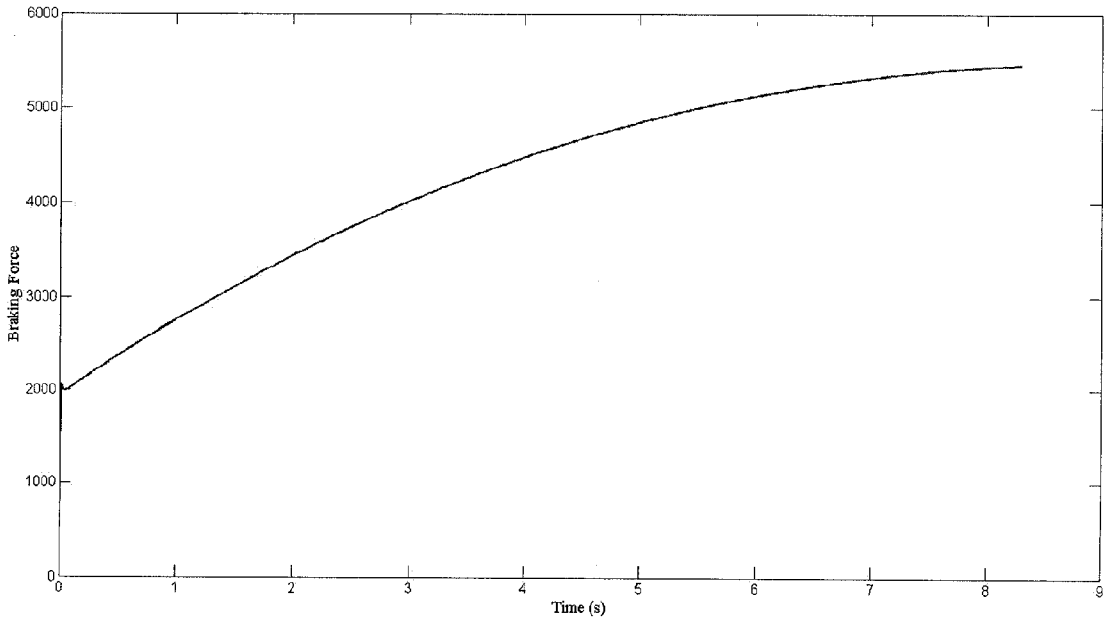
FIG. 25 illustrates braking force versus time in a particular implementation of the present invention.

FIG. 24 illustrates the pressure in the HP. As can be seen, pressure increases to more than 50 bar. FIG. 25 illustrates braking force versus time.

As shown in Table 6, the efficiency of energy storing is 44%, which is significantly better than by using the single tank implementation. This significantly increases the capacity of energy storing and efficiency of regenerative braking.

TABLE 6

| | |
|---|---|
| Maximum Pressure in the Tank | 52.4 bar |
| Braking Time | 8.3 s |
| Efficiency | 44% |

The maximum pressure achievable in the HP, when two tanks are provided, can be expressed as:

$$P2 = CR\left(\frac{T_{max}}{T_0}\right)\left(\frac{1 + CR\frac{V_1}{V_0}}{1 + \frac{V_1}{V_0}}\right)$$

where $T_{max}$ is the maximum allowed temperature of the HP, $V_0$ is the cylinder volume, $V_1$ is the LP volume and $T_0$ is the atmospheric temperature. The maximum pressure in the main storage is a function of $$\frac{V_1}{V_0}\text{: and } \frac{T_{max}}{T_0}$$

when two storage tanks are provided. Assuming a case wherein $$\frac{T_{max}}{T_0} = 2.5 \text{ and } \frac{V_1}{V_0} = 1,$$

it can be shown that the maximum pressure could increase to 137.5 bar, a great improvement over the prior art that can reach only 25 bar. Consequently the use of two tanks can increase the stored energy by a factor of 5. The above mentioned system can not only increase the capacity of energy storing, but also improve the efficiency of the air motor mode.

Effect of Adding More Tanks

Figure 26:
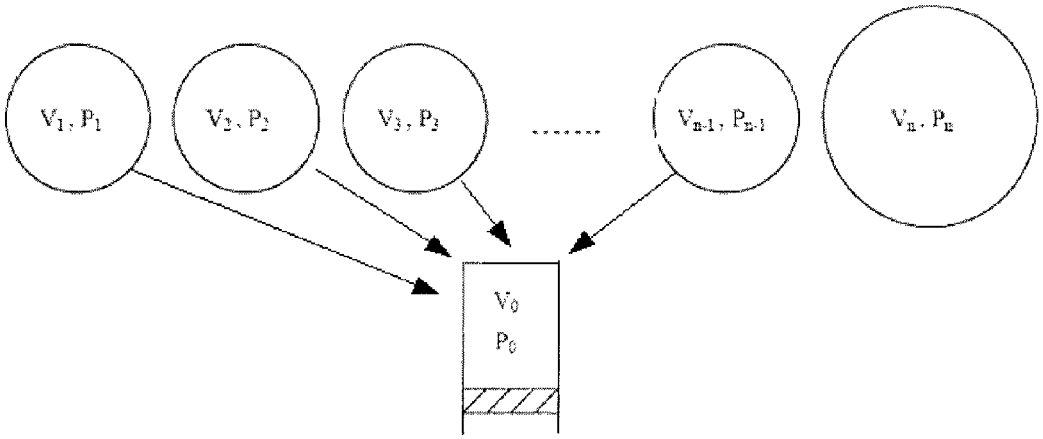
FIG. 26 illustrates an n tank implementation.
Figure 27:
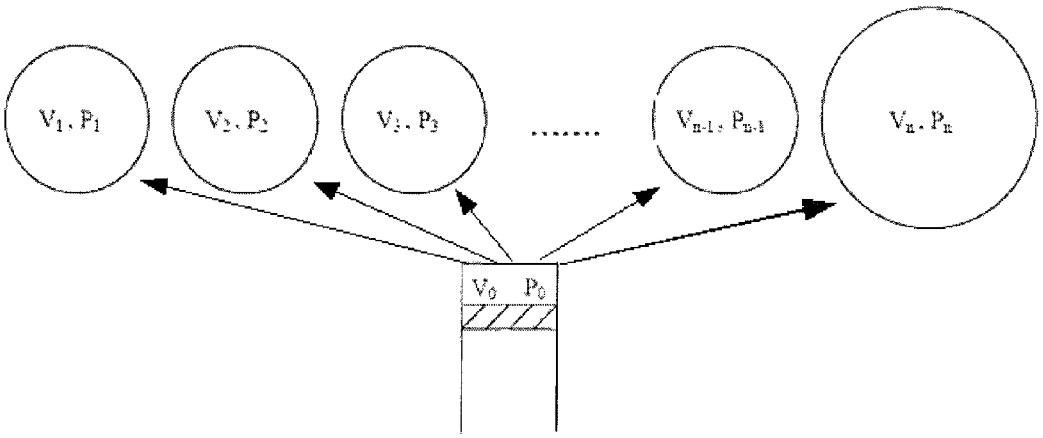
FIG. 27 illustrates the charging valves of all the tanks opening and closing in reverse order one by one from the main storage to the first storage.

It is possible to use n air tanks wherein the last one is the main (or HP) tank. FIG. 26 illustrates an n air tank implementation. The initial pressure of each air tank may be given by $P_i$. These air tanks may be filled using the same procedure presented above, but with each air tank being charged one at a time. Therefore, the cylinder may begin by being filled at atmospheric pressure, then the charging valves of each air tank except the last one (main/HP) may successively open and close. Next, the piston may move up to Top Dead Point (TDP) and compress the air adiabatically. Finally, as illustrated in FIG. 27, the charging valves of all the air tanks may open and close in reverse order one by one from the main air tank to the first air tank.

Defining $$\alpha_k = \frac{V_k}{V_0 + V_k}$$

and $$\beta_k = \frac{V_k}{\frac{V_0}{C.R.} + V_k},$$

where $V_0$ is cylinder volume and $V_k$ is $k^{th}$ air tank volume, the cylinder pressure, after feeding the cylinder with $k^{th}$ tank, $P_c^k$, can be calculated using following relation:

$$P_c^k = P_{atm}\prod_{i=1}^{k}(1-\alpha_i) + \sum_{i=1}^{k}\alpha_i P_i \prod_{j=i+1}^{k}(1-\alpha_j)$$

The cylinder pressure at the end of feeding the cylinder by n− air tanks may be given by:

$$P_c^{n-1} = P_{atm}\prod_{i=1}^{n-1}(1-\alpha_i) + \sum_{i=1}^{n-1}\alpha_i P_i \prod_{j=i+1}^{n-1}(1-\alpha_j)$$

After the piston moves up to the TDP, the cylinder pressure after compression may be given by:

$$P_c^* = \left[P_{atm}\prod_{i=1}^{n-1}(1-\alpha_i) + \sum_{i=1}^{n-1}\alpha_i P_i \prod_{j=i+1}^{n-1}(1-\alpha_j)\right](C.R.)^{1.4}$$

Next the charging valve of main air tank (HP) may open. The pressure after feeding the HP can be calculated as follows:

$$P_n = (1-\beta_n)\left[P_{atm}\prod_{i=1}^{n-1}(1-\alpha_i) + \sum_{i=1}^{n-1}\alpha_i P_i \prod_{j=i+1}^{n-1}(1-\alpha_j)\right](C.R.)^{1.4} + \beta_n P_n$$

The charging valves of other air tanks may then open and close, and the cylinder pressure after feeding the $k^{th}$ air tank may be given by:

$$P_c^k = \left[\prod_{i=k}^{n}(1-\beta_i)\right]\left[P_{atm}\prod_{i=1}^{n-1}(1-\alpha_i) + \sum_{i=1}^{n-1}\alpha_i P_i \prod_{j=i+1}^{n-1}(1-\alpha_j)\right](C.R.)^{1.4} + \sum_{L=k}^{n} P_L\beta_L\prod_{j=k}^{L-1}(1-\beta_j)$$

Figure 28:
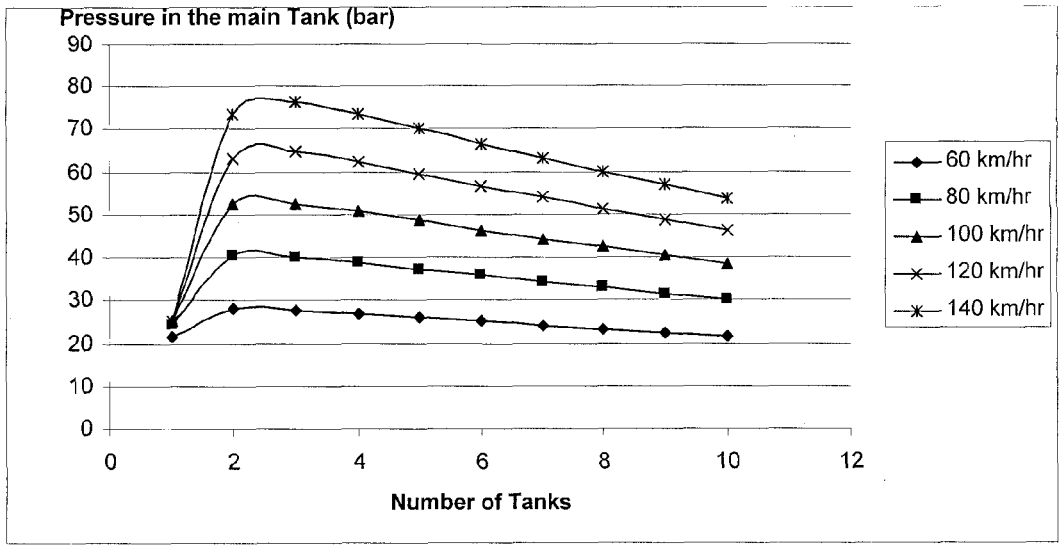
FIG. 28 illustrates an example of the performance of regenerative braking using a varying number of tanks.

FIG. 28 illustrates an example of the performance of regenerative braking using a varying number of air tanks. For the purposes of FIG. 28, the vehicle specified in Table 6 is used and the vehicle is decelerated from a number of different initial velocities. Storage specifications are given in Table 7.

TABLE 7

| | |
|---|---|
| Storages initial pressure | 1 bar |
| Main Storage Temperature | 750 K |
| Small Storages Temperature | 298 K |
| Main Storage Volume | 30 L |
| Small Storages Volume | 2 L |

As can be observed in FIG. 28, the maximum pressure can occur when two air tanks are used, regardless of initial velocity. In some cases it may appear that three air tanks provides further advantages, however these advantages are typically minimal compared to their added weight and complexity.

Figure 29:
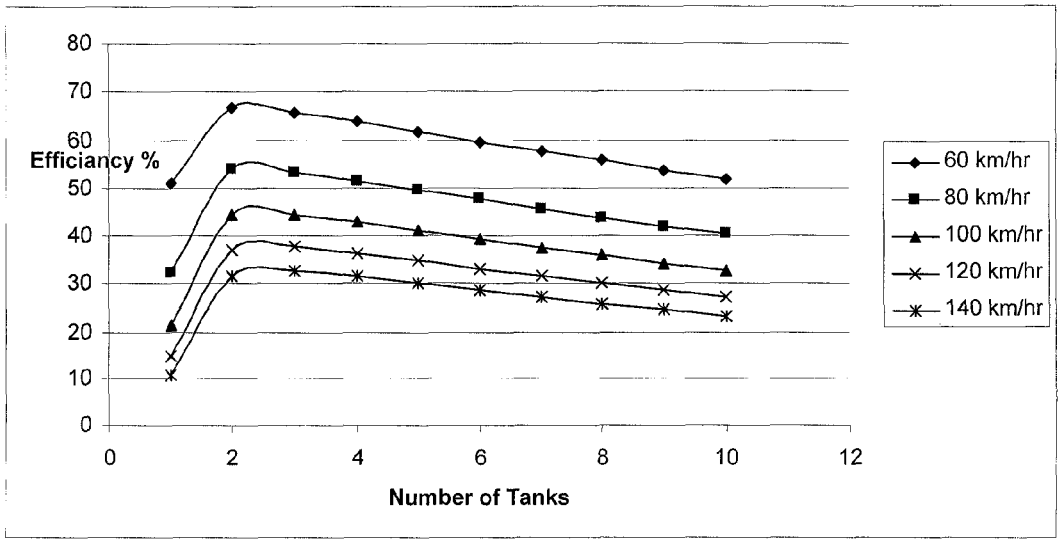
FIG. 29 illustrates the efficiency of regenerative braking related to different initial velocities, for different number of tanks.

FIG. 29 illustrates the efficiency of regenerative braking related to different initial velocities, for different number of air tanks. As can be seen, again using two air tanks produces the maximum efficiency regardless of initial speed.

Thus it has been shown that using two air tanks can optimize regenerative braking efficiency and its performance.

It has further been found that the optimal value for the two air tanks to have the maximum efficiency of energy storing is as given below in Table 9. Table 8 illustrates ranges for the air tank parameters considering physical space and temperature limitations in a typical vehicle.

TABLE 8

| | |
|---|---|
| Main Air Tank Volume Range | [0.01-0.05] $m^3$ |
| Small Air Tank Volume Range | [0.000001-0.005] $m^3$ |
| Main Air Tank Temperature Range | [298-550] K |
| Small Air Tank Temperature Range | [298-550] K |

TABLE 9

| | |
|---|---|
| Main Air Tank Volume | 0.05 $m^3$ |
| Small Air Tank Volume | 0.0007 $m^3$ |
| Main Air Tank Temperature | 550 K |
| Small Air Tank Temperature | 298 K |

It is observed that the main air tank (HP) volume should be set as high as possible and the LP temperature should be as cool as possible to increase the efficiency of energy storing. This shows that in order to have maximum efficiency, the LP should be cooled down and the temperature of the HP should be kept as high as possible.

Efficiency reduces as the LP heats. The LP ma y be cooled down using one of the following techniques: (i) the addition of fins to the LP body to increase heat transfer from the LP to the surrounding (environment) air; (ii) the addition of an air blower to increase heat convection rate and/or placing the LP in the vehicle air flow path; (iii) the use of a heat exchanger and a liquid cooling system such as the engine liquid cooling system; or (iv) any combination of the above three techniques.

Additionally, the compression process in the cylinder heats the inlet air to the HP. The heat is a part of the energy recovery during regenerative braking periods. Insulation of the HP may be used to reduce heat losses from the HP. The technique used for insulation of the HP includes any known insulation technique.

Simulation

The above findings can be supported by simulation using commercially available tools such as GT-Power™ and MATLAB-SIMULINK™. By modelling the system, the optimum regenerative braking efficiency can be shown to have two storage tanks as provided above.

Figure 30:
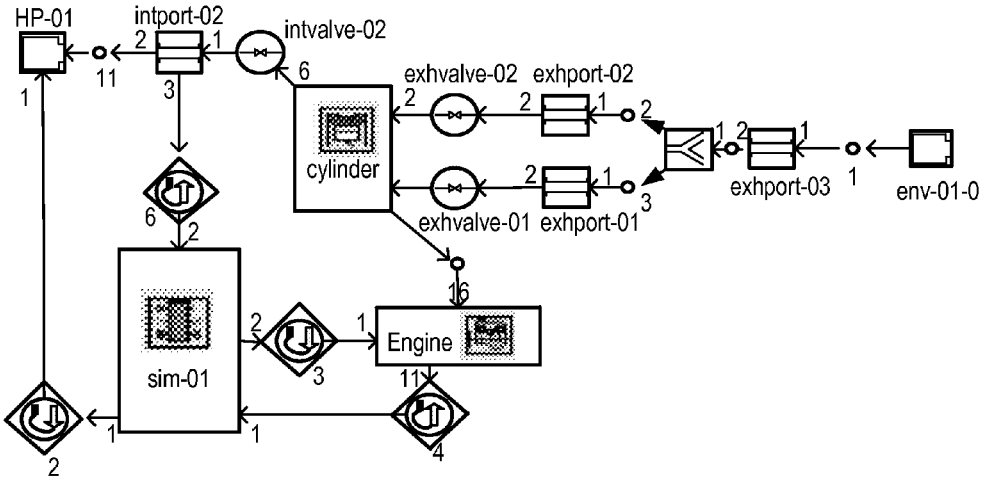
FIG. 30 illustrates the air hybrid engine model in GT-Power with only one storage tank.
Figure 31:
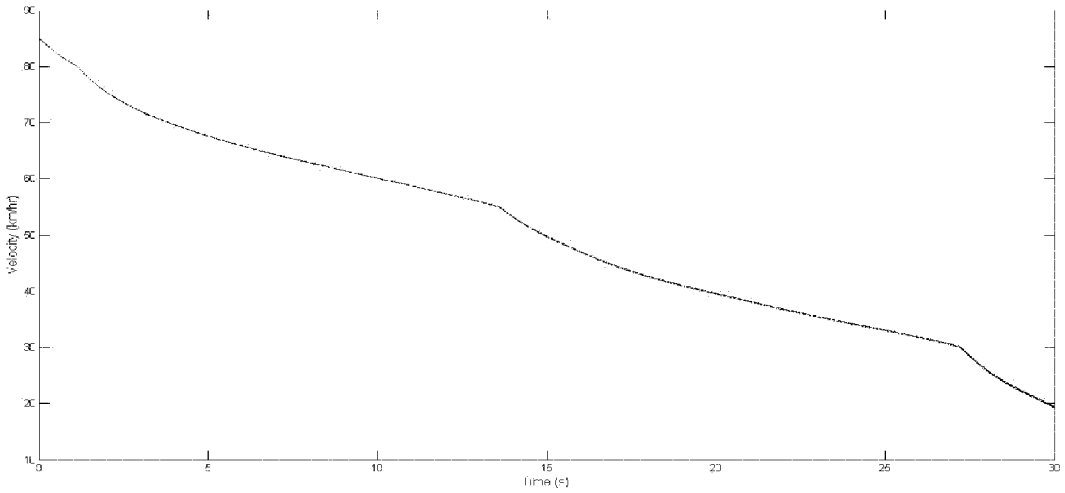
FIG. 31 illustrates vehicle velocity in the main tank during braking.
Figure 32:
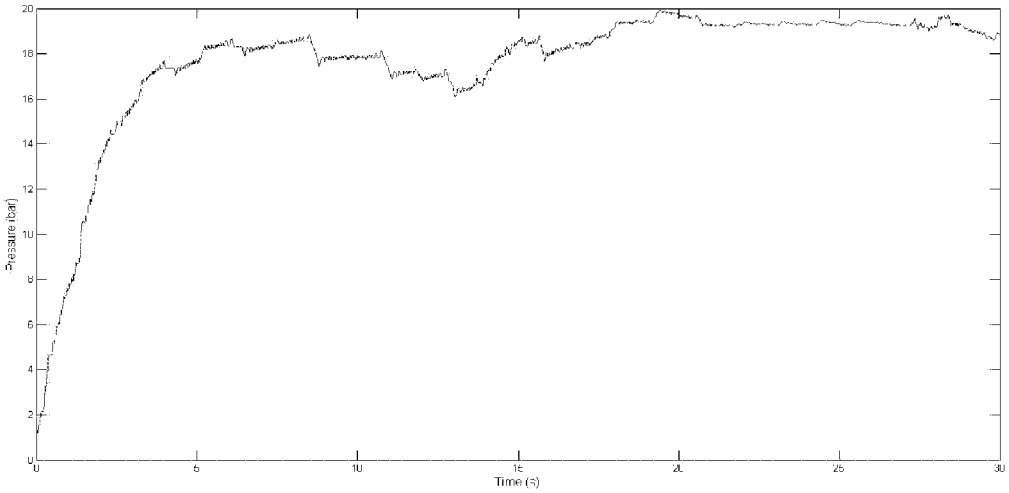
FIG. 32 illustrates air pressure in the main tank during braking.

FIG. 30 illustrates the air hybrid engine model in GT-Power with only one air tank. FIGS. 31 and 32 illustrate vehicle velocity and air pressure, respectively, in the main air tank during braking. As can be seen, the air tank pressure goes up to only 19 bar.

Figure 33:
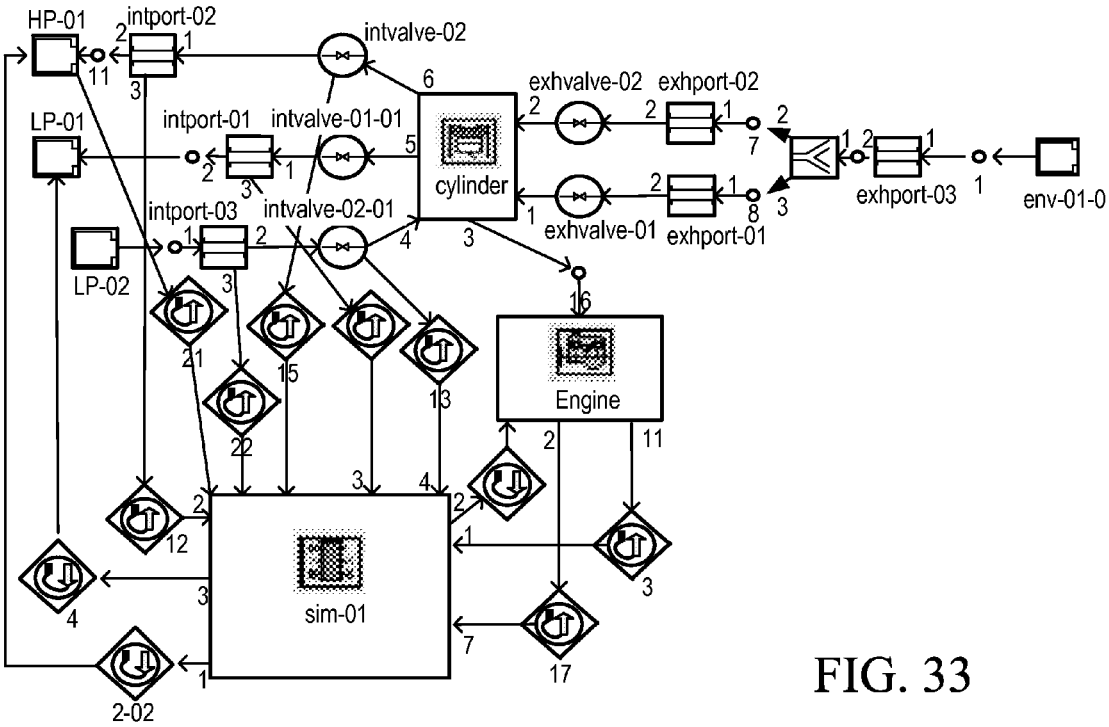
FIG. 33 illustrates the same air hybrid engine model in GT-Power with two storage tanks.
Figure 34:
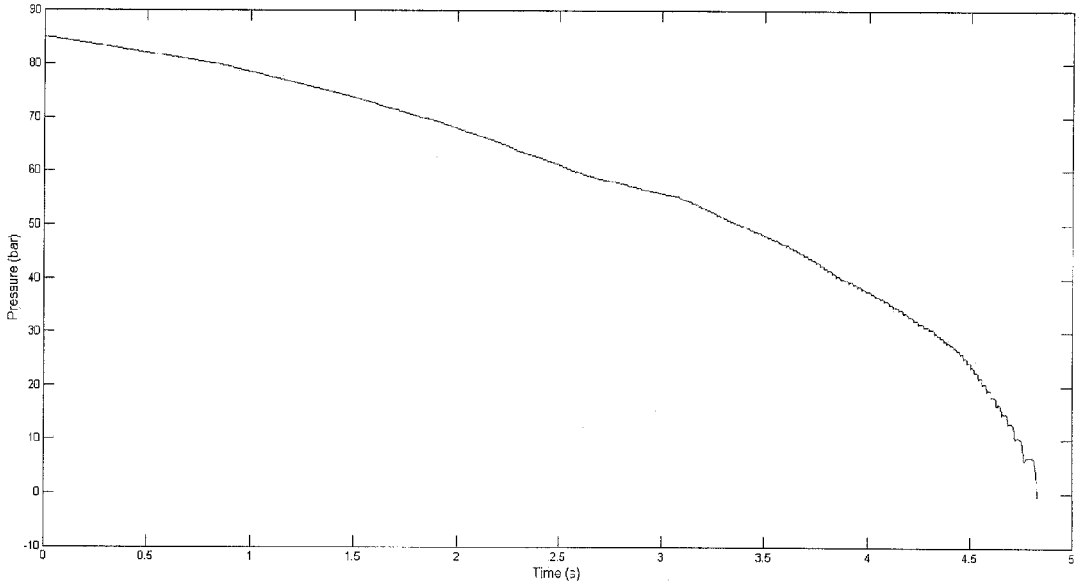
FIG. 34 illustrates the vehicle velocity in the main tank during braking.
Figure 35:
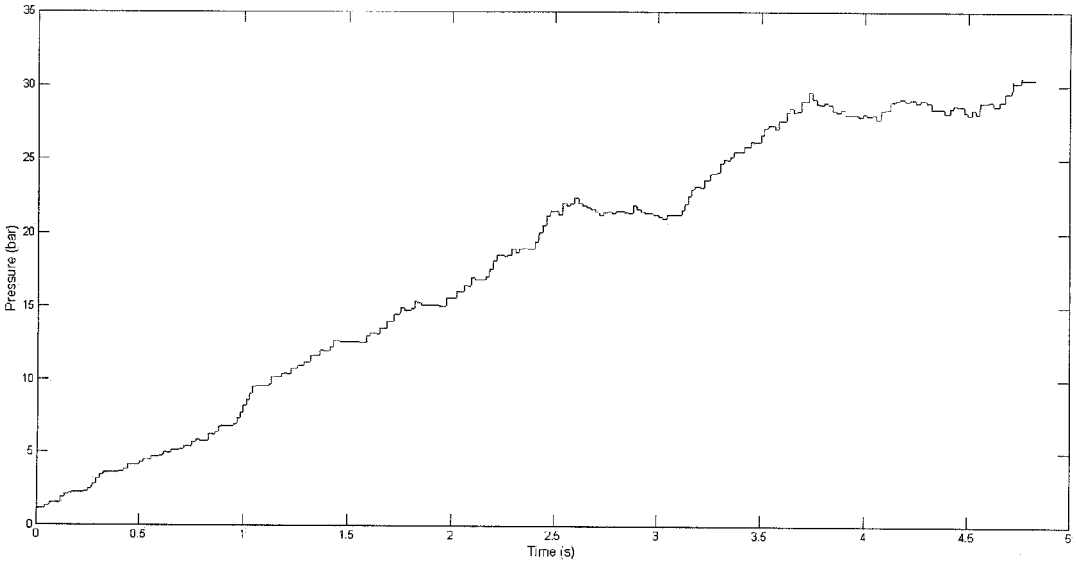
FIG. 35 illustrates the air pressure in the main tank during braking.

FIG. 33 illustrates the same air hybrid engine model in GT-Power with two air tanks. FIGS. 34 and 35 illustrate the vehicle velocity and air pressure, respectively, in the main air tank (HP) during braking. As can be seen, using two air tanks significantly decreases the braking time and increases the air pressure in the HP from 19 bar to 30 bar.

Experiment

Figure 5:
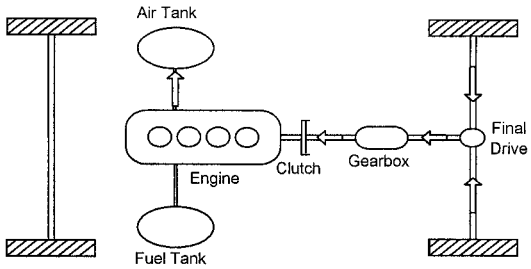
FIG. 5 PRIOR ART
FIG. 5 illustrates the compression mode of an air hybrid engine.
Figure 6:
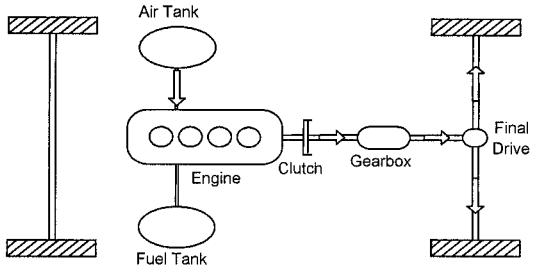
FIG. 6 PRIOR ART
FIG. 6 illustrates the air motor mode of an air hybrid engine.
Figure 7:
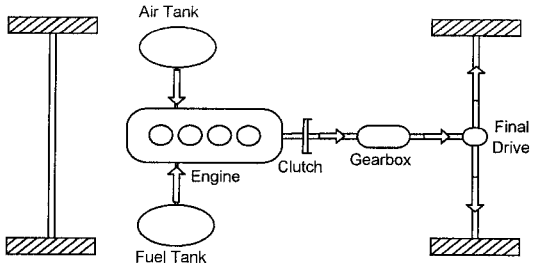
FIG. 7 illustrates the air power assisted mode (supercharged) of an air hybrid engine.
Figure 8:
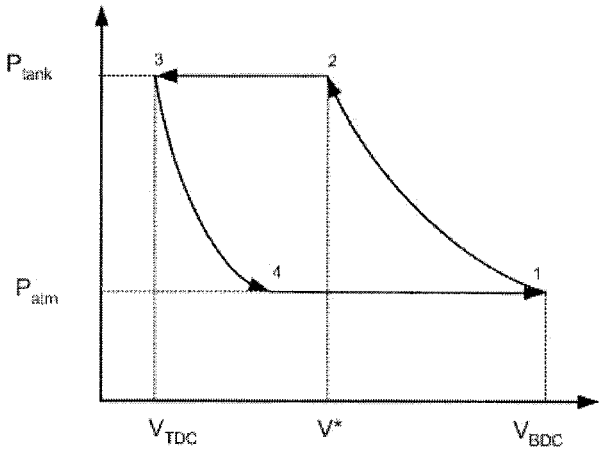
FIG. 8 PRIOR ART
FIG. 8 illustrates the ideal air cycle of the single tank system.
Figure 9:
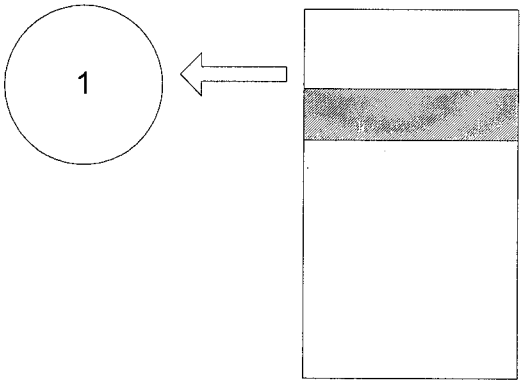
FIG. 9 illustrates a typical air hybrid engine during regenerative braking.
Figure 10:
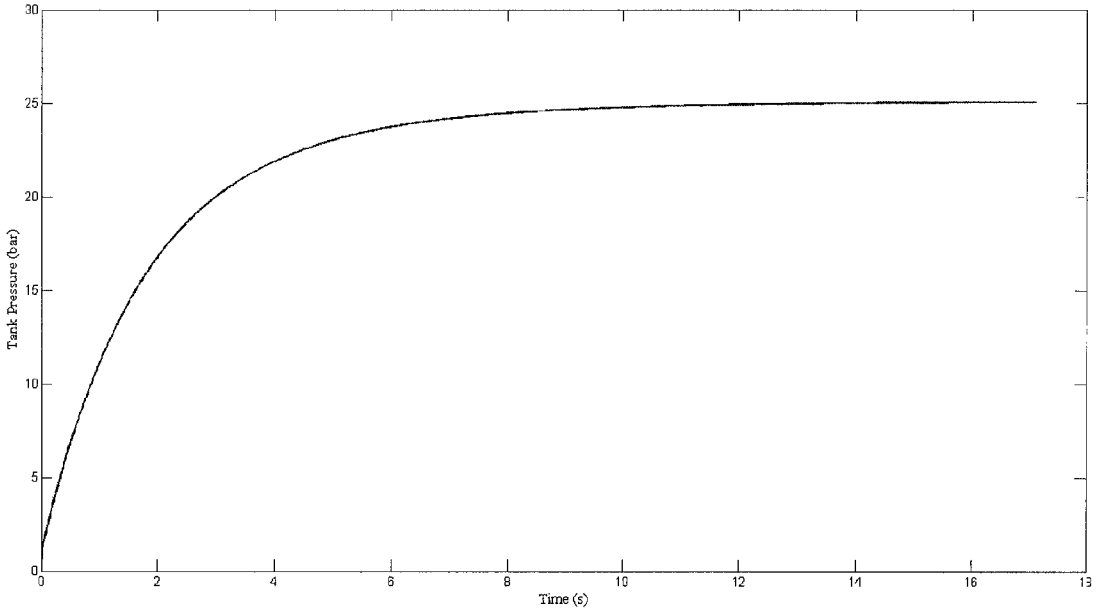
FIG. 10 illustrates the pressure profile in the air tank versus time for a typical air hybrid engine implementation.
Figure 36:
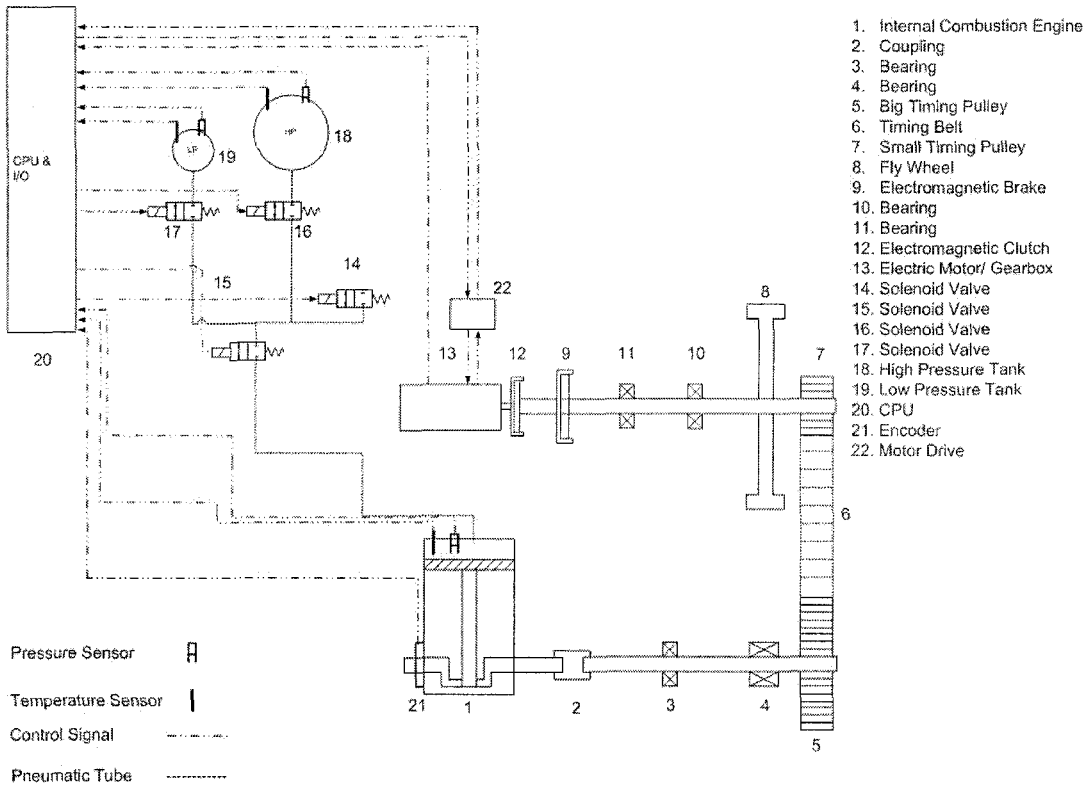
FIG. 36 illustrates a test apparatus for verifying a single state double tank engine apparatus of the present invention.

FIG. 36 illustrates a test apparatus for verifying the single stage double tank engine apparatus of the present invention. A servo DC motor is connected to a flywheel through an electromagnetic clutch. There is also an electromagnetic brake mounted on the shaft. The electric motor shaft is connected to the engine shaft by a timing pulleys set with the ratio of 60/28. The engine shaft is connected to the engine and an absolute encoder. The encoder's signal defines the accurate angular position of the crank shaft w.r.t. Top Dead Center (TDC). The engine cylinder is connected to the LP and HP tanks through solenoid valves which are controlled by a Beckhoff PLC controller as shown in FIG. 5. The experimental results are then compared with the mathematical model.

A Kohler single cylinder engine with the displacement volume of 426 cc is provided. The engine and air tanks' characteristics are shown in Table 10.

TABLE 10

| Engine and air tanks' characteristics | |
|---|---|
| Bore | 90 mm |
| Stroke | 67 mm |
| Compression ratio | 8.5 |
| LP volume | 450 cc |
| HP volume | 2 l |

High-speed solenoid valves are used in this project to implement and compare the single stage double tank and single stage single tank compression strategies.

Figure 37:
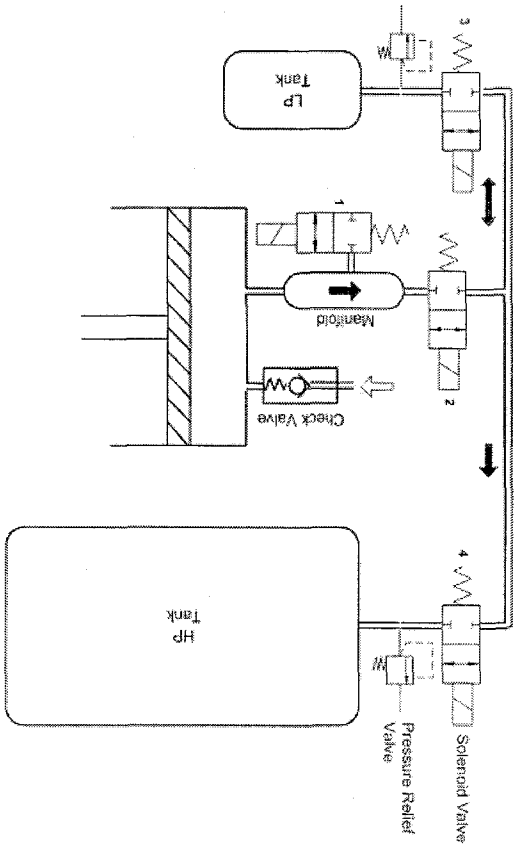
FIG. 37 illustrates a cylinder head configuration.

The conventional cylinder head is completely removed and a new cylinder head is designed and fabricated. The cylinder head configuration is shown in FIG. 37. In this configuration, a check valve with relatively low breaking pressure is directly mounted on the cylinder head to let the atmospheric air flow into the cylinder when the piston goes down. A manifold is also designed and manufactured to connect the cylinder to other parts of the setup. Two solenoids ('1' and '2') are mounted directly on this manifold. The first solenoid connects the cylinder to the environment and is only active during start up or emergency braking. The second one connects cylinder to the tank set. Solenoids '3' and '4' are LP and HP valves, respectively. The selected solenoid valves have the characteristics listed in Table 11.

TABLE 11

| Solenoid valves characteristics | |
|---|---|
| Response Time | 20 ms |
| $K_v$ | 2.5 $m^3/h$ |
| Maximum allowable temperature | 100 c |

Figure 38:
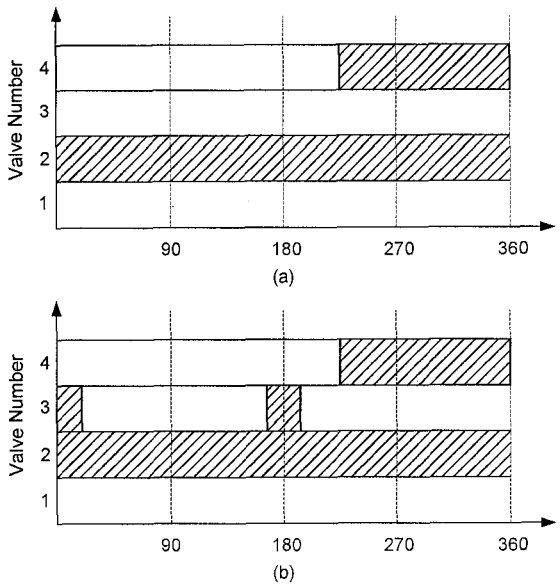
FIG. 38 illustrates approximate valve timing of single tank and double tank compression strategies respectively based on crank angle.

FIGS. 38(*a*) and (*b*) illustrate approximate valve timing of single tank and double tank compression strategies respectively based on crank angle. Valve '1' is always closed, valve '2' is always open, and valve '4' opens after BDC and closes in the vicinity of TDC. Valve '3', which is only activated in double tank system, opens and closes twice in each engine revolution—once after TDC and once after Bottom Dead Center (BDC).

Following the valves timing depicted in FIG. 38, single tank and double tank compression strategies can be implemented and compared experimentally. The ICE speed is set to 42 rpm to ensure that all the solenoid valves have enough time to switch on and off. However, the same result could be expected for higher engine speeds.

Valve '2' is opened at first to let the ICE rotate without negative torque. Then, the PLC activates the regenerative cycle by closing the second valve and controlling other valves, based on FIG. 38. This procedure is done for the single tank regenerative system and for the double tank systems by activating and deactivating the third valve.

Figure 39:
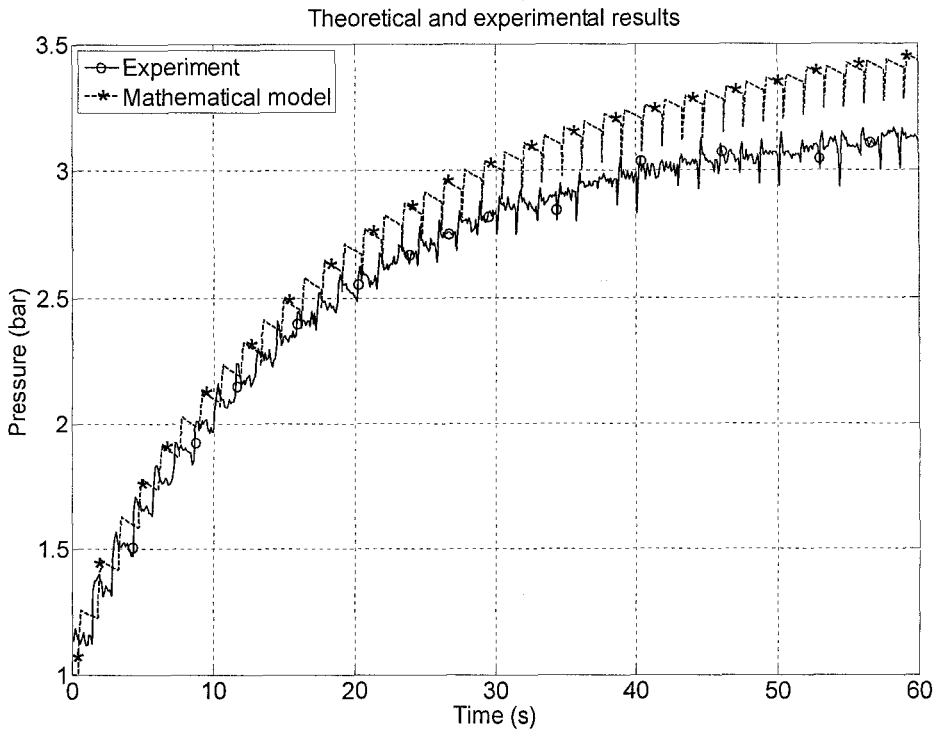
FIG. 39 illustrates a mathematical model and experimental results for HP tank pressure.

The experimental and mathematical results are shown in FIG. 39.

Table 12 shows solenoid valve timing for the single tank system. As can be seen, solenoids '1' and '3' are closed, solenoid '2' is always open, and solenoid '4' is activated based on the crank angle.

TABLE 12

| Solenoid valves activation | |
|---|---|
| Solenoid '1' | Always closed |
| Solenoid '2' | Always open |
| Solenoid '3' | Always closed |
| Solenoid '4' | Opens from 290 to 360 CAD |

The mathematical model and experimental results for the HP tank pressure are shown in FIG. 39. A close correlation between the theoretical model and the experiment can be seen. The tank pressure increases to more than 3 bar after 60 seconds, but the rate of pressure increase decreases rapidly with time. It is noteworthy that since the cylinder head is completely replaced with a new one, the compression ratio of the system is decreased from 8.5 (Table 1) to less than 4 because the volume of the manifold and all the connecting pipes are added to the dead volume of the cylinder. However, the actual compression ratio of the engine can be preserved if a camless valvetrain is utilized.

Figure 56:
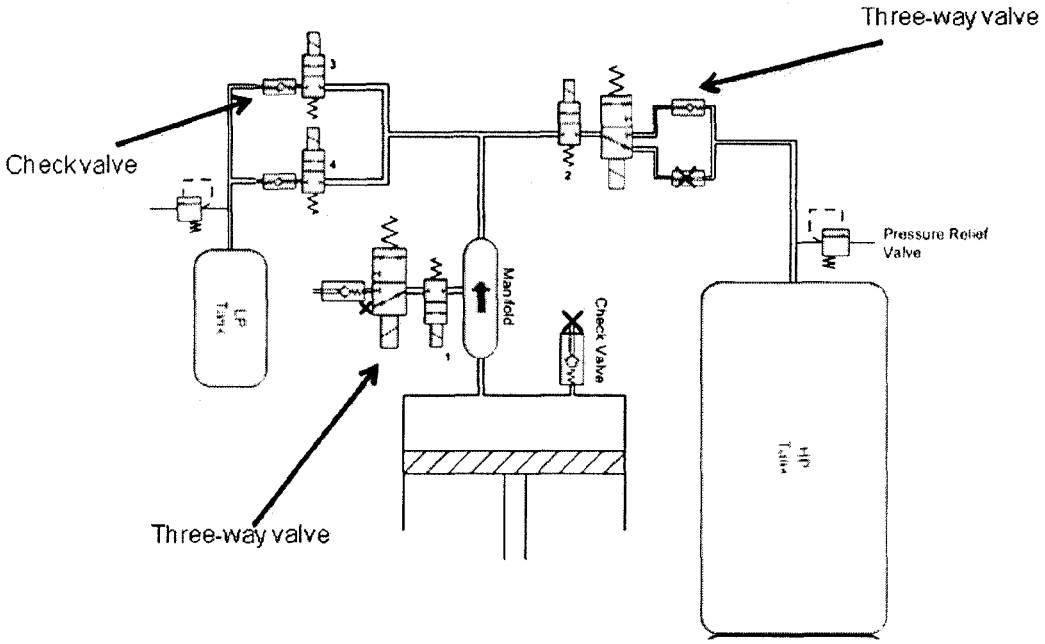
FIG. 56 illustrates a test apparatus for verifying the semi-flexible valvetrain of the present invention.
Figure 57:
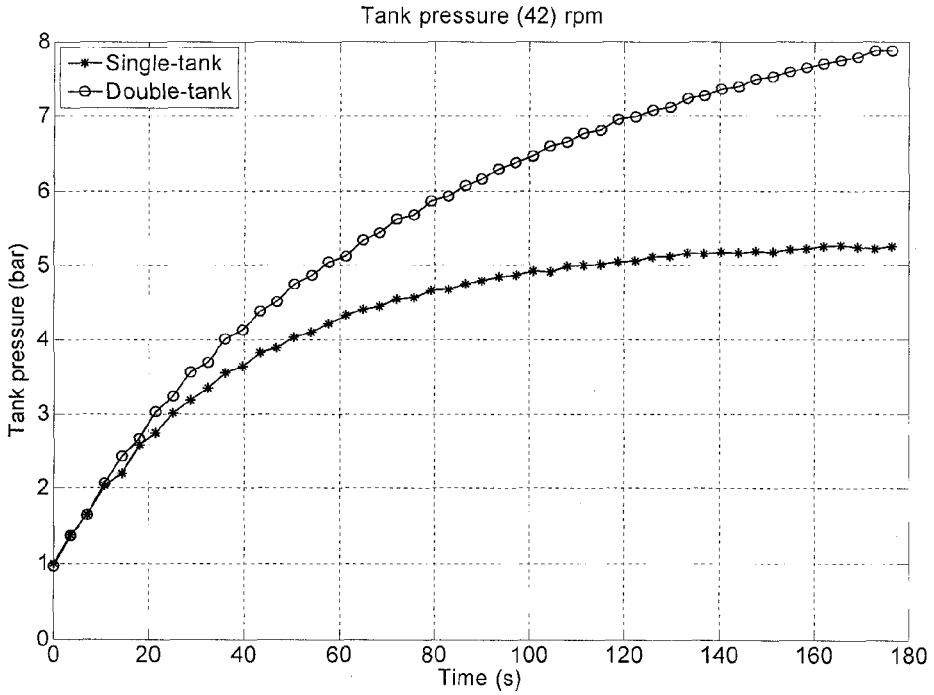
FIG. 57 illustrates the HP tank pressure after 180 s at an engine speed of 42 rpm.

Table 13 shows solenoid valve timing for the double tank system. Solenoid '3' switches on and off twice in each cycle, once in the vicinity of TDC and once in the vicinity of BTC. The results are shown in FIGS. 56 and 57.

TABLE 13

| Solenoid valves activation | |
|---|---|
| Solenoid '1' | Always closed |
| Solenoid '2' | Always open |
| Solenoid '3' | Opens from 170 to 190 and from 5 to 25 CAD |
| Solenoid '4' | Opens from 290 to 360 CAD |

Figure 40:
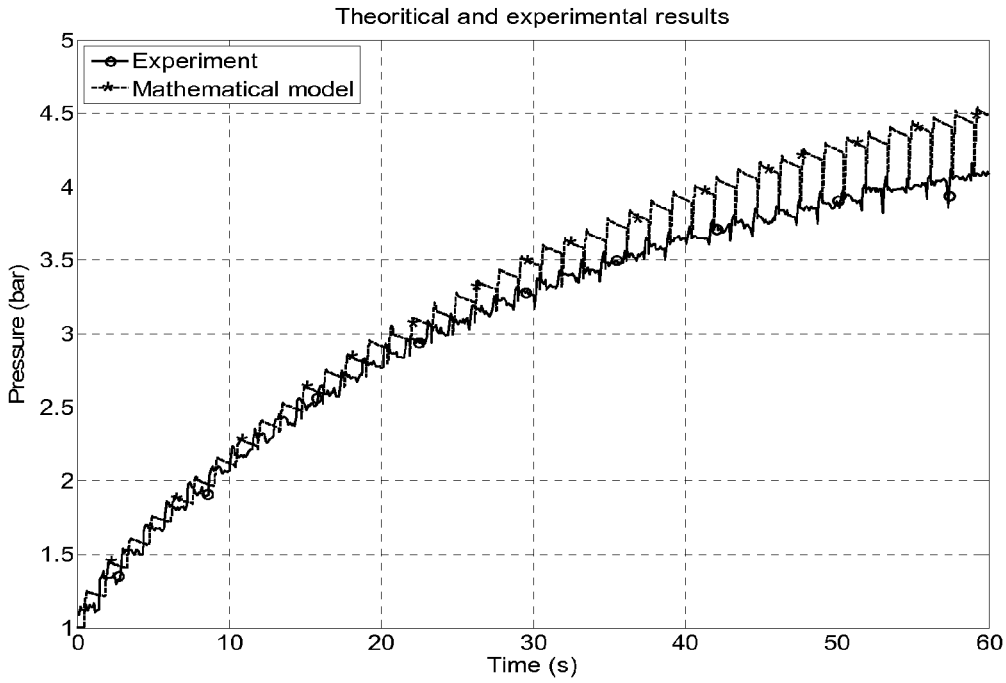
FIG. 40 illustrates HP tank pressure increasing to more than 4 bar after 60 seconds for double tank system.
Figure 41:
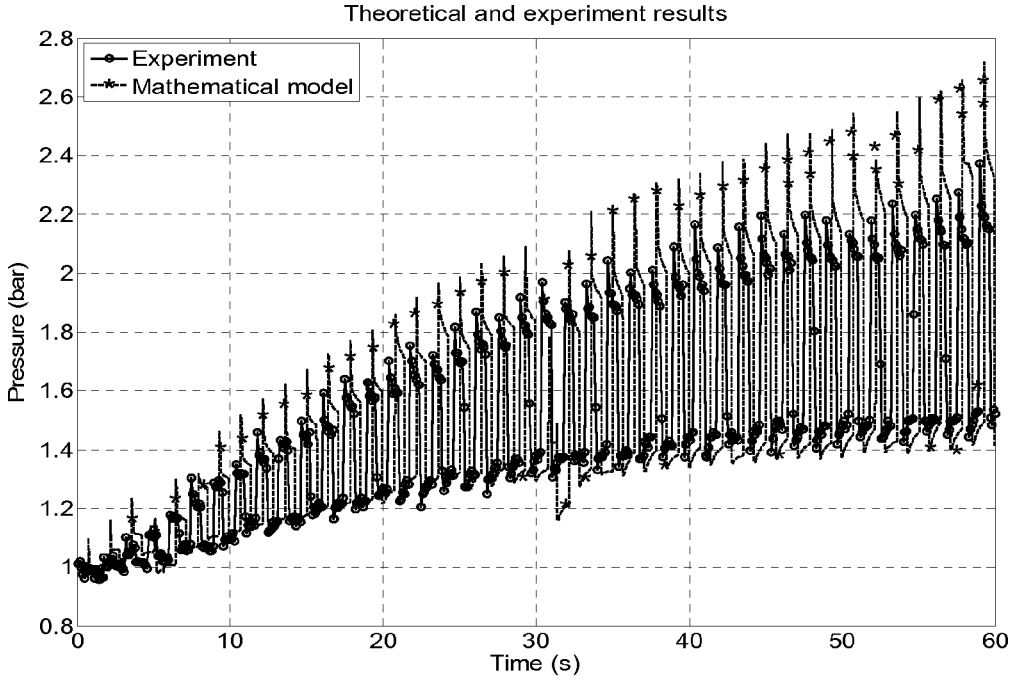
FIG. 41 illustrates the LP tank pressure variation.

As can be seen in FIG. 40, the HP pressure increases to more than 4 bar after 60 seconds for double tank system. The theoretical model also shows good agreement with the experiment. FIG. 41 illustrates the LP pressure variation. As can be seen, the LP works as an auxiliary tank which stores the unused pressurized air at TDC and delivers it back to the cylinder at BDC.

Figure 42:
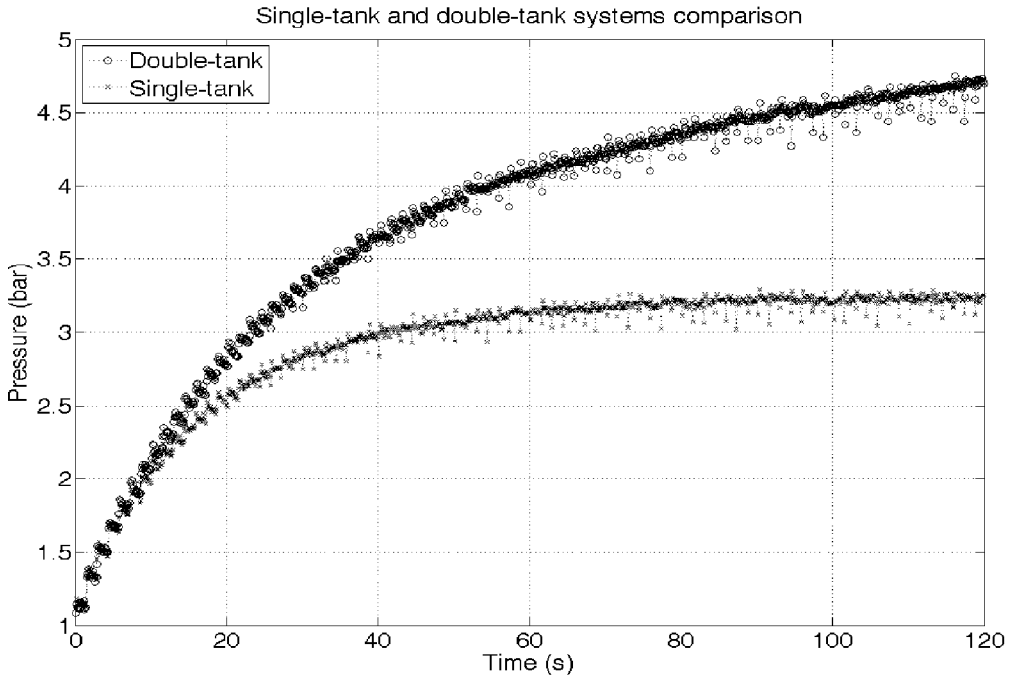
FIG. 42 shows the experimental results for single tank and double tank compression after 120 seconds.

FIG. 42 shows the experimental results for single tank and double tank compression after 120 seconds. There is a limit to the air pressure in the HP (about 3.2 bar) when single tank compression is used. The HP pressure remains almost constant after passing 50 seconds from the beginning of the experiment. However, using the double tank compression method, not only does the pressure increase to more than 4.7 bar, but the rate of pressure change is also positive, which means that the pressure goes even higher than 4.7 bar after 120 seconds. It should be noted that the results are obtained with fixed valve timing and a much greater difference between single tank and double tank system performance could be expected if valve timings are optimized based on the LP and HP tank pressures. The experimental result shown on FIG. 42 indicates about 70% improvement in storing pressure after 120 s by utilizing the double tank compression method which proves the efficacy of the present invention.

Camless Valvetrain Implementation

Figure 43:
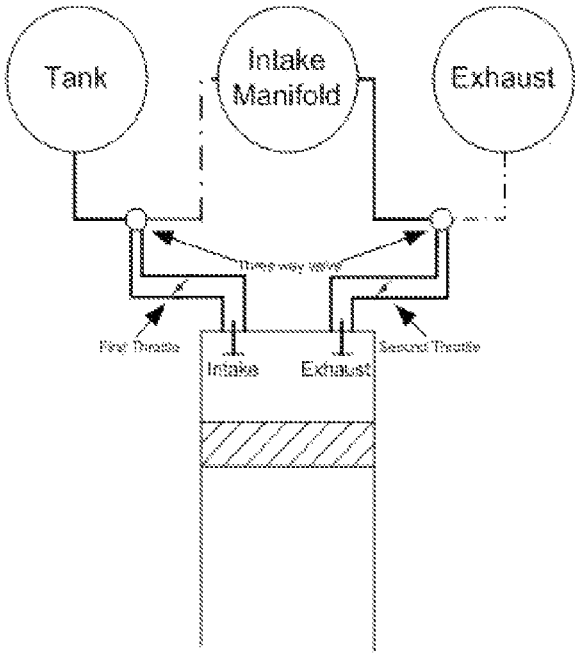
FIG. 43 illustrates the camless valvetrain of the present invention, in one aspect thereof.

The present invention provides a camless valvetrain with fixed timing at different modes of engine operation. In this approach, valve timing is kept constant at each mode but it changes with the change of the engine's operational mode by using a solenoid. FIG. 43 illustrates the camless valvetrain of the present invention, in one aspect thereof. In particular, FIG. 43 illustrates a camless valvetrain for a single tank air hybrid engine configured in accordance with the present invention.

The desired load at each mode is obtained by utilizing two throttles as shown in FIG. 43. This approach can be used both in single and multi-tank air hybrid engines. In this configuration, the first throttle is active at the conventional and air motor modes to control the amount of traction load and the second throttle is activated at the regenerative braking mode (compression mode) to control the amount of braking torque. In this way the camless valve train with fixed timing can be used to implement an air hybrid engine.

The present invention, in one aspect thereof, provides a system for adapting a two tank air hybrid engine apparatus for an existing four cylinder engine. It should be understood that present invention can be readily adapted for an existing engine having any number of cylinders. As described above, a typical air hybrid engine has an extra valve that is connected to the air tank. However, considering that current typical engines have four valves on the cylinder head, there may not be enough room for adding one or two more valves. Since there is no room on the cylinder head for adding charging valves, it is necessary to connect two storage tanks without adding more valves on the cylinder head. This can be accomplished using the configuration shown in FIGS. 44 to 46. In this configuration, four three-way valves (indicated by a circle) and a fully flexible valvetrain such as camless valvetrain may be used.

Figure 44:
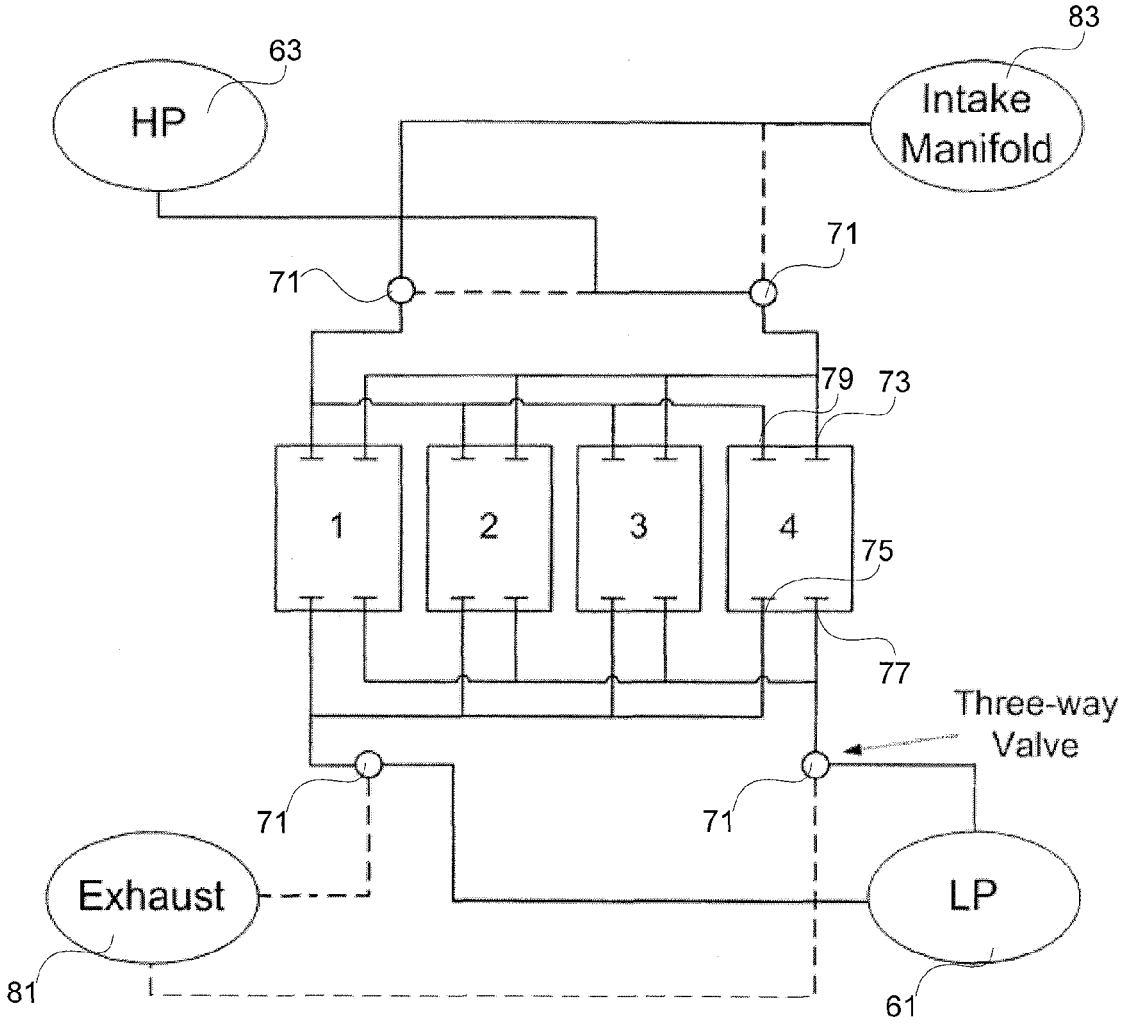
FIG. 44 illustrates the configuration during braking.

FIG. 44 illustrates the configuration during braking in compression mode. In this mode, one of the intake valves 73 of each cylinder is connected to the HP 63, the two exhaust valves 77, 77 are connected to the LP 61 and the other intake valve 79 is connected to the intake manifold 83 to suck the atmospheric air by controlling the four three-way valves.

Figure 45:
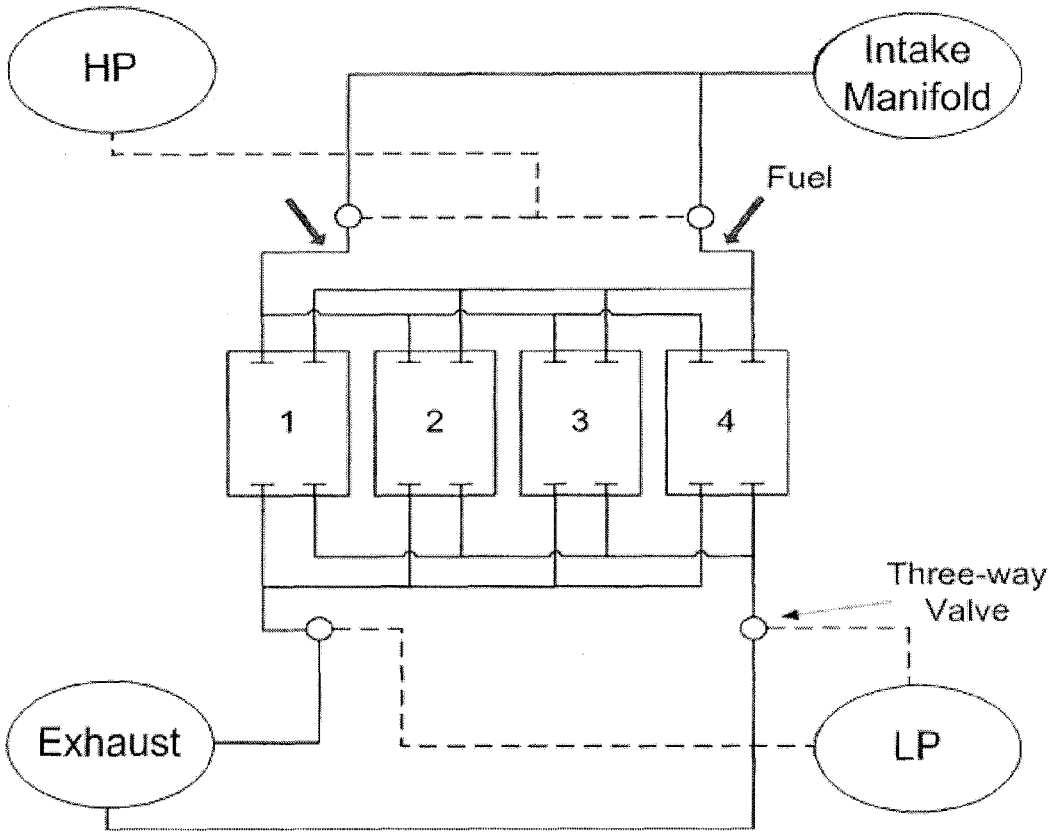
FIG. 45 illustrates the system configuration in the engine conventional mode.

FIG. 45 illustrates the system configuration in the conventional combustion mode. In this mode, intake valves 73, 79 are connected to the intake manifold 83 and exhaust valves 75, 77 are connected to the exhaust manifold 81.

Figure 46:
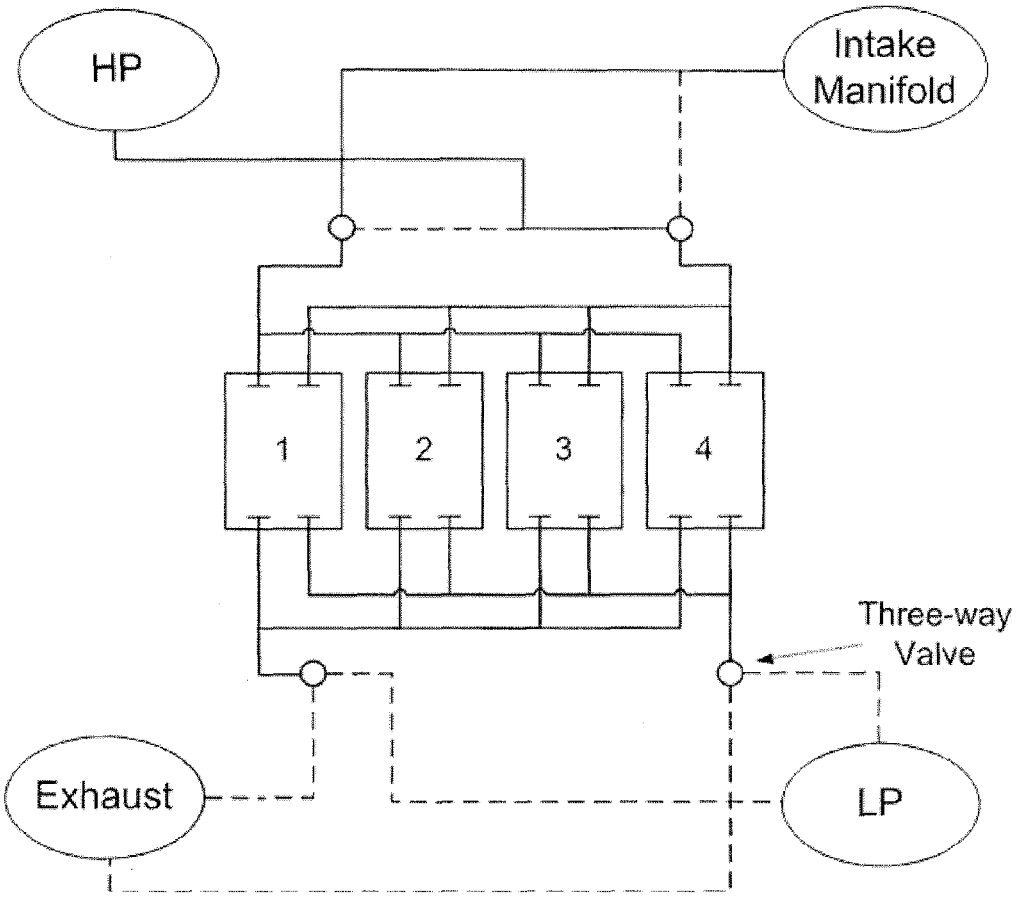
FIG. 46 illustrates the system configuration in the air motor mode.

FIG. 46 illustrates the system configuration in the air motor mode. In this mode, one of the intake valves 73, 79 is connected to the HP 63 and the other intake valve 79 is connected to the intake manifold 83. The exhaust valves 75, 77 are deactivated. In this way, cooling the exhaust treatment system is avoided.

Figure 47:
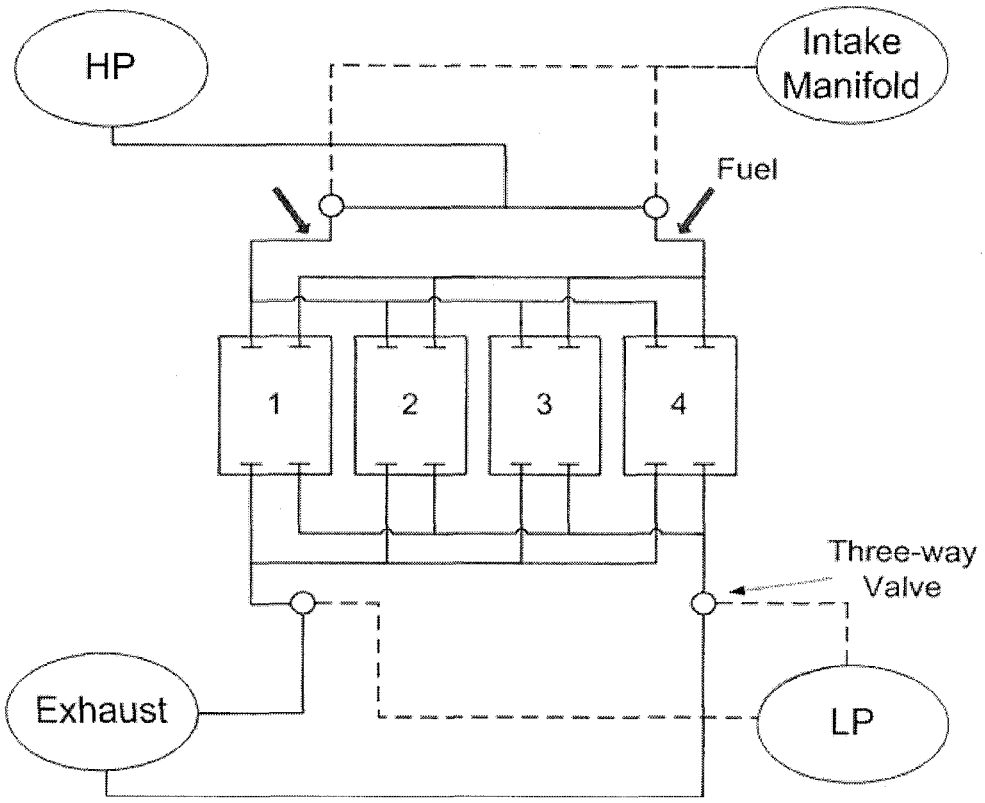
FIG. 47 illustrates the system configuration in the air assist (supercharged) mode.

FIG. 47 illustrates the system configuration in the air assist (supercharged) mode. In this mode the intake valves 73, 79 are connected to the HP 63 and the exhaust valves 75, 77 are connected to the exhaust manifold 81.

Thus, utilizing the proposed configuration, different modes of operation could be implemented without adding any extra valves to the cylinder head.

As previously mentioned, existing valvetrains may not be optimal when used with air hybrid engines due to the need of different valve timing requirements in air hybrid engines.

Cam-Based Valvetrain Implementation

One of the most important challenges of implementing an air hybrid engine is the inevitability of using fully flexible valvetrain in air hybrid engines to implement all the operational modes. Although conventional valvetrains limit the performance of an engine and cannot practically be used in an air hybrid engine, they have definite operational advantages, as the valve motion is governed by a cam profile designed to confine the valve seating velocity and lift [4]. The seating velocity in a cam-based valvetrain is limited below 0.5 m/s [4], which leads to durability and low noise [4]. In contrast, a flexible camless valvetrain with no direct mechanical connection with the engine, introduces a difficult control problem. Consequently, advanced control techniques may be applied to perform accurate valve timing and low seating velocity at a wide range of engine speeds, which increases the cost and complexity of the system.

The present invention provides a cam-based flexible valvetrain with fixed timing at different modes of engine operation. The cam-based flexible valvetrain can use for example V-tec™ technology and a plurality of directional air flow regulators to implement the compression braking mode, conventional mode and start up mode in an air hybrid engine. V-tec technology enables selective engagement of a particular cam to each valves for particular desired engine modes, as is known. The directional air flow regulator may, for example, be a check valve.

Figure 48:
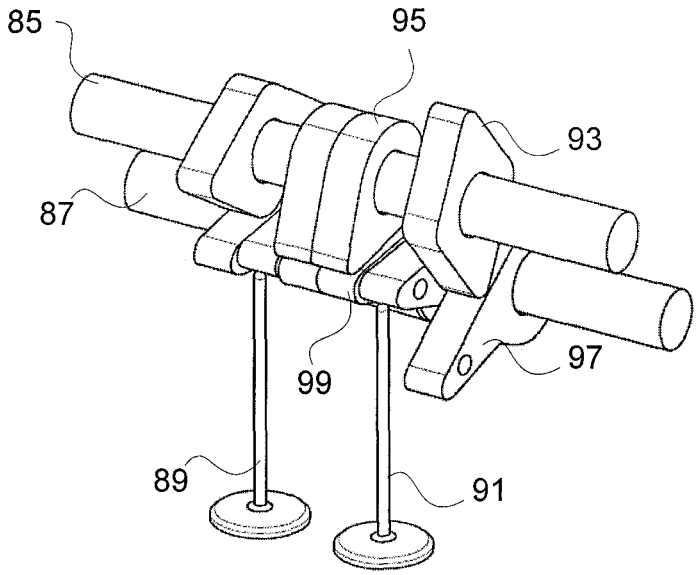
FIG. 48 illustrates a perspective view of a cam shaft arrangement in accordance with the present invention.
Figure 64:
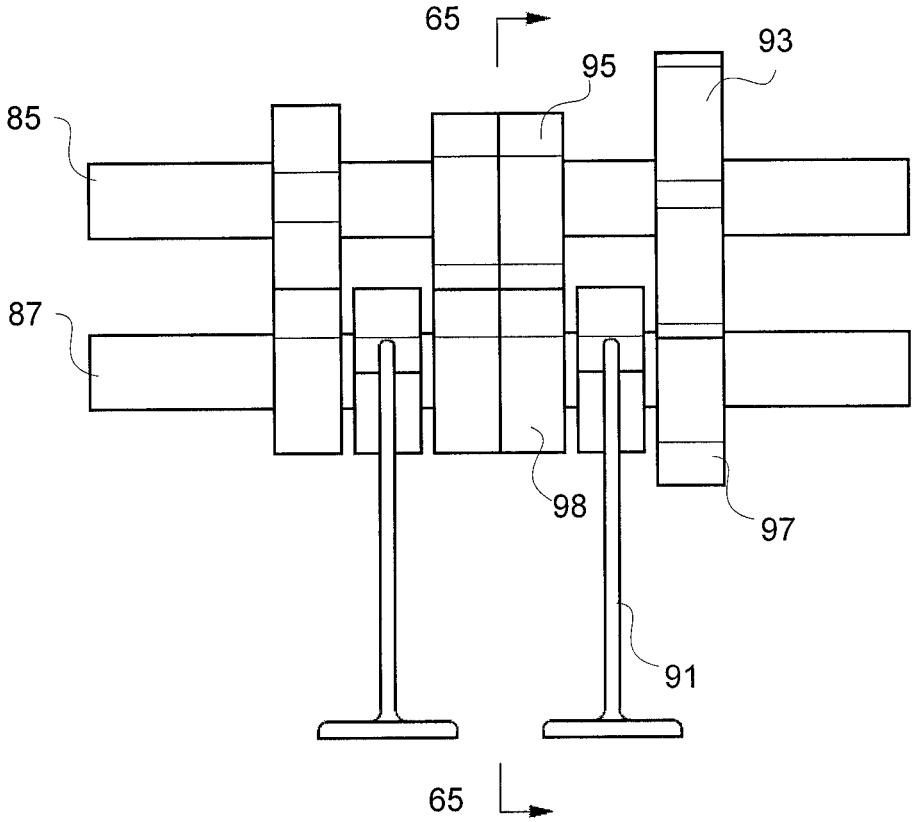
FIG. 64 illustrates a front view of the cam shaft arrangement previously shown in FIG. 48.
Figure 65:
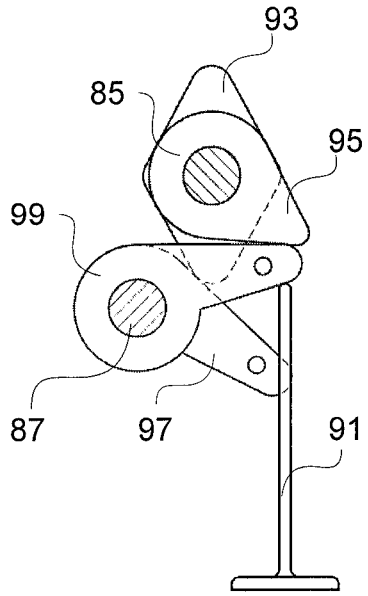
FIG. 65 illustrates a cross sectional side view of the cam shaft arrangement previously shown in FIG. 64 along the line 65-65.

FIG. 48 illustrates a cam shaft arrangement in accordance with the present invention. FIG. 64 illustrates a front view of the cam shaft arrangement. FIG. 65 illustrates a cross sectional side view of the cam shaft arrangement along the line 65-65 in FIG. 64.

The cam shaft arrangement includes a cam shaft 85 and a cam follower shaft 87. The cam shaft 85 and cam follower shaft 87 are disposed in substantially parallel alignment. An engine cylinder for use with the cam shaft arrangement has two valve control arms 89, 91 that can be selectively coupled to cam followers radially extending from the cam follower shaft.

The cam shaft includes one two-stroke cam 93 and one four-stroke cam 95 disposed around the cam shaft for each valve. The cam follower shaft has a two-stroke cam follower 97 radially extending therefrom that follows the travel of the two-stroke cam as the cam shaft rotates. The cam follower shaft has a four-stroke cam follower 99 radially extending therefrom that follows the travel of the four-stroke cam as the cam shaft rotates.

The four-stroke cam follower is coupled to the valve during conventional mode. Coupling the four-stroke cam follower to the valve will result in conventional valve timing (for example, about 280° of CAD opening for the intake valve and about 300° of CAD opening for the exhaust valve).

The two-stroke cam follower is coupled to the valve during compression mode or start up mode. Coupling the two-stroke cam follower to the valve will result in 140° of CAD opening for the intake valve and 150° of CAD opening for the exhaust valve.

Utilizing this cam shaft apparatus, the engine can operate as a four-stroke engine and two-stroke engine. Thus the engine operational mode can be selectively changed from a four-stoke mode with fixed valve timing to a two-stroke mode with another fixed valve timing.

Utilizing this arrangement, the challenge of changing the operational modes of the engine from four-stroke to two-stroke or vice versa, which is needed for changing the operational mode in air hybrid engines, is resolved. However, the above valvetrain result in the fixed valves timing of 140° of CAD or 150° of CAD at two-stroke operational modes which might not be desirable. For example, as discussed in the double tank compression strategy, the charging valve between LP and the cylinder should be opened and closed one while the piston is in the vicinity of the BDC and once while the piston is in the vicinity of TDC. Opening duration of 140° of CAD or 150° of CAD makes the implementation of the double tank compression strategy almost impossible.

Figure 49:
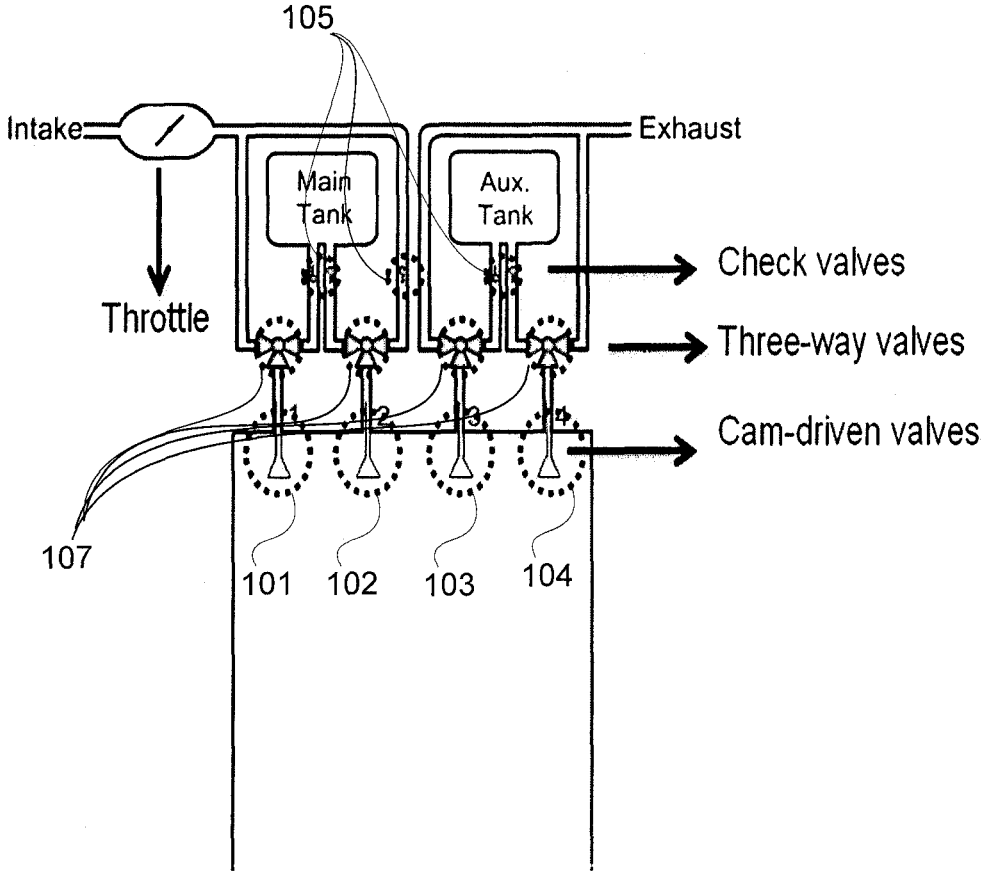
FIG. 49 illustrates directional air flow regulators disposed in the connecting means between the HP, LP, intake manifold and the cylinder.

To address this, the engine may also include one or more directional air flow regulators disposed along the air flow path to be regulated. The directional air flow regulators may be check valves 101. The directional air flow regulators may be disposed in the connecting means between the HP, LP, intake manifold and the cylinder as shown in FIG. 49. The overlap of the engine valves and directional air flow regulators provides the desired valve timing for compressor, conventional and start up modes. Four three-way valves 103 may also be provided for changing the operational mode.

Figure 50:
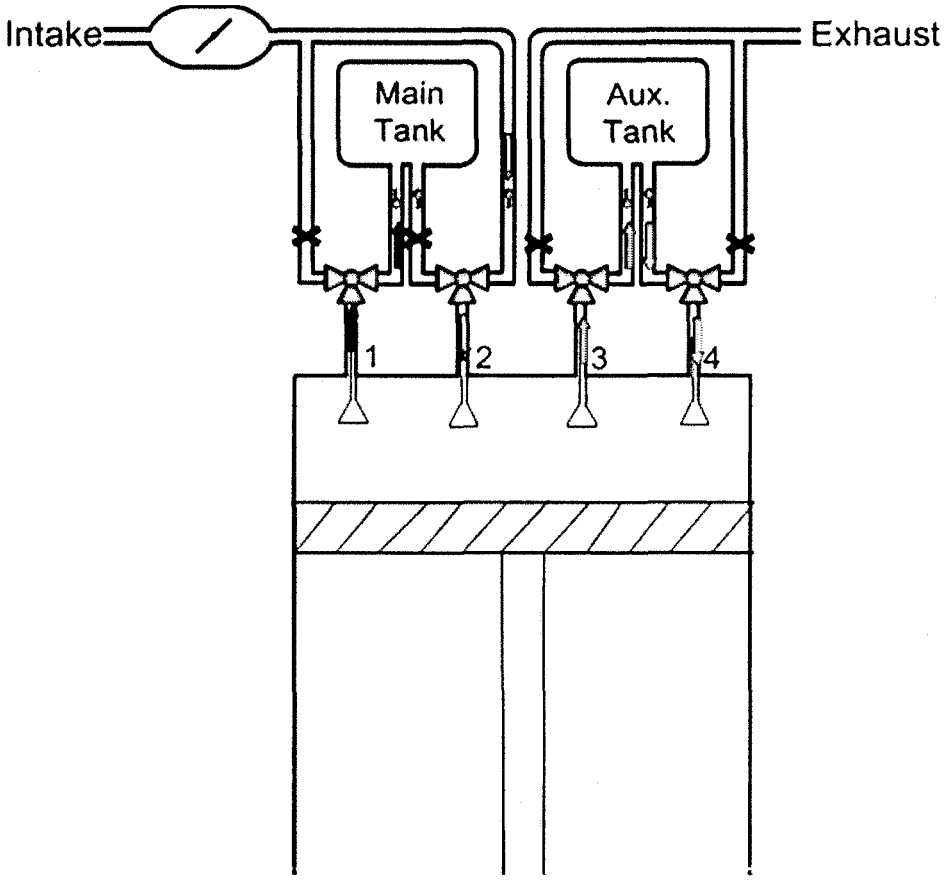
FIG. 50 illustrates the valve configuration and air flow in compression mode.

FIG. 50 illustrates a representative valve configuration and air flow in compression mode. In this mode, two-stroke cam followers are coupled to the engine valves and lead to the valves timing shown in FIG. 51. The connecting means shown with 'X' (intake manifold with valve 101, HP with valve 102, exhaust manifold with valve 103 and exhaust manifold with valve 104) prevent air flow by means of the cam arrangement and/or three-way valves.

Figure 51:
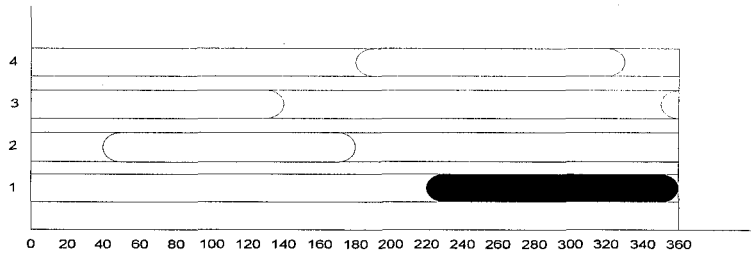
FIG. 51 shows the timing of the valve '2' which is introduced by one of the two-stroke cams.

Valve 102 may be connected to the intake manifold. Providing a directional air flow regulator as shown in FIG. 50 in the connecting means between the intake manifold and valve 102 ensures that the air flow is always from the intake to the cylinder. FIG. 51 shows the timing of the valve 102 which is introduced by one of the two-stroke cams. As can be seen, valve 102 is open from about 40° of CAD to about 180° of CAD. That means the valve 102 is open when the piston is going down and if the pressure in the cylinder is less than the atmospheric pressure, then there is air flow from the intake manifold to the cylinder. However if the cylinder pressure in the cylinder is higher than atmospheric pressure at the beginning of the valve 102 opening, the directional air flow regulator prevents the evacuation of the cylinder through the intake manifold.

Valve 104 is open from about 180° of CAD to about 330° of CAD. By providing a directional air flow regulator in the connecting means from LP to valve 104 ensures that there is only flow from LP to the cylinder if the pressure in the LP is higher than the pressure in the cylinder. Thus, the combination of the directional air flow regulator and engine valve 104 results in the desired flow from the LP to the cylinder when the piston is in the vicinity of BDC.

Valve 101 is connected to the main tank (HP) and is open from about 220° of CAD to about 360° of CAD. Providing a directional air flow regulator in the connecting means from valve 101 to the HP ensures that there is only air flow from the cylinder to the HP if the cylinder pressure is higher than the HP pressure and therefore there is no blow down from the tank to the cylinder.

Valve 103 is connected to the LP and is open from about 350° of CAD to about 150° of CAD. Providing a directional air flow regulator in the connecting means from the cylinder to the LP ensures that there is only a flow from the cylinder to the LP if the cylinder pressure is higher than the LP pressure.

This way, the double tank strategy can be implemented by utilizing cam-based valvetrain described above and a set of check valves and three-way valves.

An electronic throttle system can control the engine torque during braking by controlling the amount of air flow to the cylinder.

Figure 52:
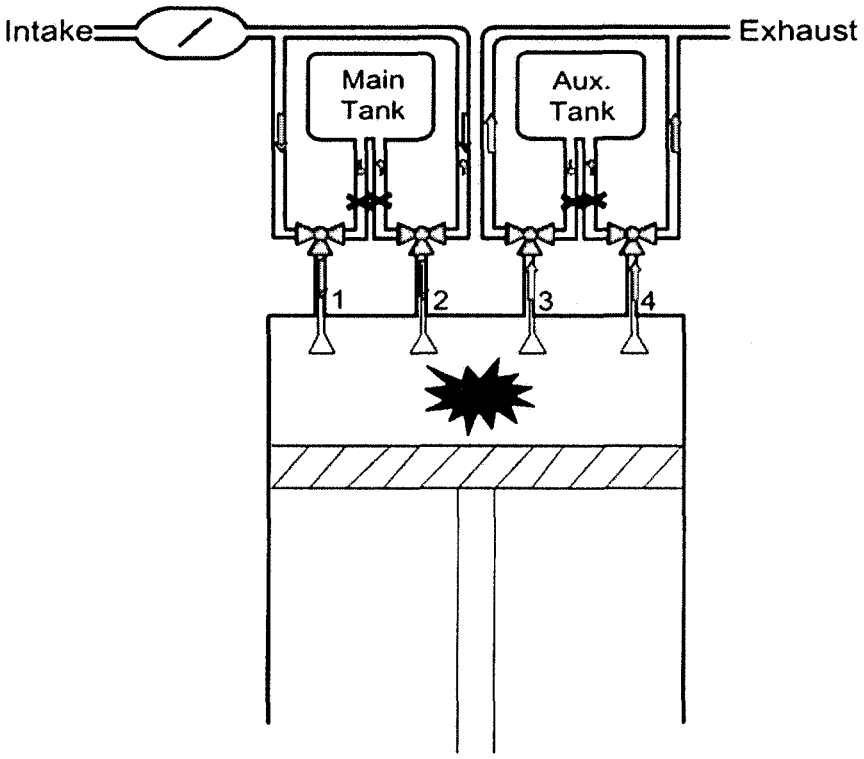
FIG. 52 illustrates the valve configuration and air flow in conventional (combustion) mode.
Figure 53:
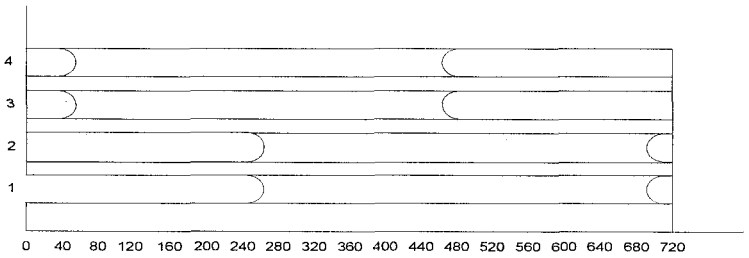
FIG. 53 illustrates valve timing when four-stroke cam followers are coupled to the engine valves.

FIG. 52 illustrates the valve configuration and air flow in conventional (combustion) mode. In this mode, four-stroke cam followers are coupled to the engine valves and lead to the valves timing shown in FIG. 53. Air flow between the HP and the cylinder, and the LP and the cylinder, is prevented. Valves 101 and 102 are connected to the intake manifold. Valves 103 and 104 are connected to the exhaust manifold. The typical four-stroke.

The electronic throttle system can manage the engine torque by controlling the amount of air flow to the cylinder.

Figure 54:
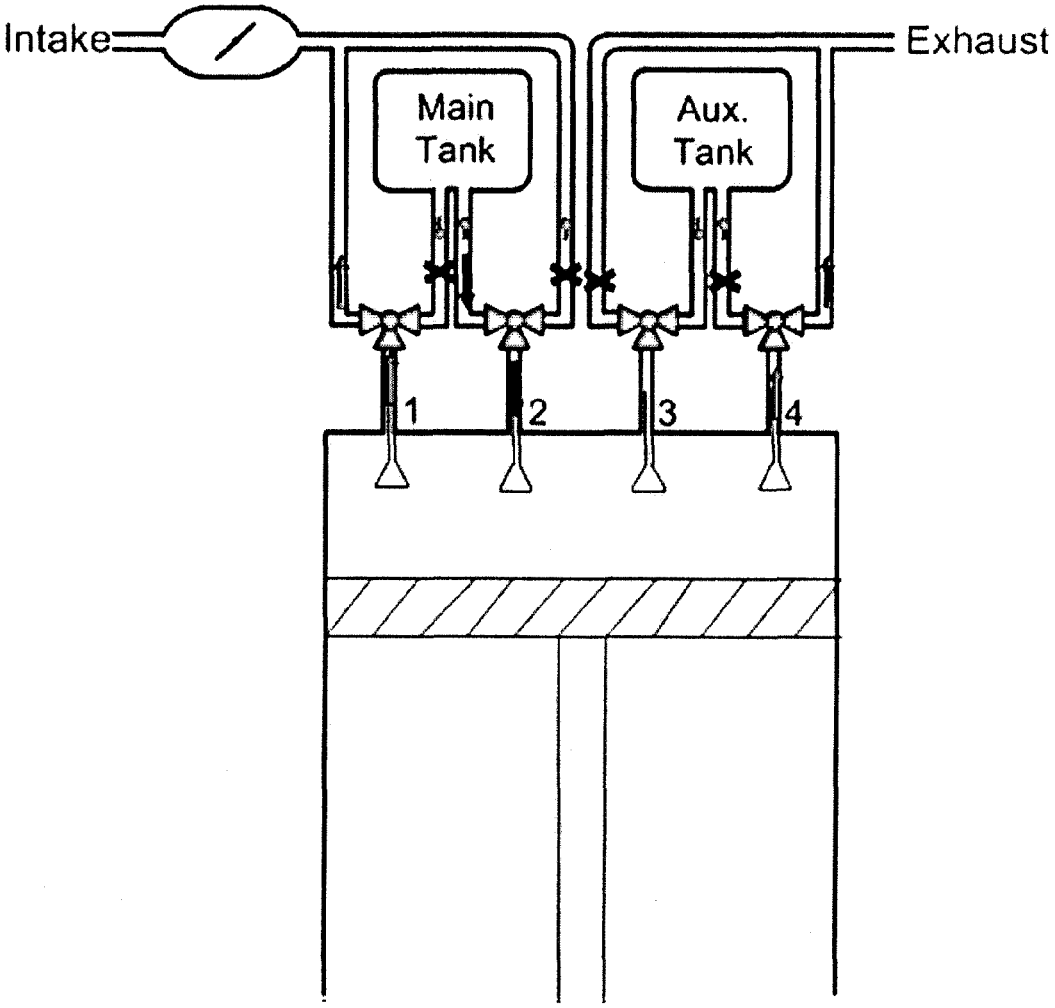
FIG. 54 illustrates the valve configuration and air flow in start up mode.
Figure 55:
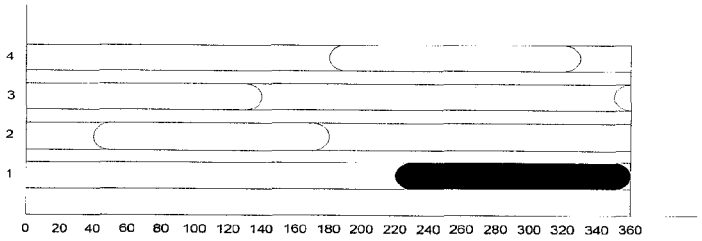
FIG. 55 illustrates valve timing when two-stroke cam followers are coupled to the engine valves.

FIG. 54 illustrates the valve configuration and air flow in start up mode. In this mode, two-stroke cam followers are coupled to the engine valves and lead to the valves timing shown in FIG. 55. The valve timing is the same as compression mode, but the three-way valve configurations are different as shown in FIG. 54. Air flow is permitted between the intake manifold and valve 101, from the HP to valve 102, and between the exhaust manifold and valve 104. In this mode, the stored pressurized air in the HP is used to start the engine. The start up mode can be activated after a long stop to avoid cold start or after a short stop to avoid idle running of the engine and will result in lower engine fuel consumption compared to a combustion engine. The powertrain clutch may be optionally disengaged at first to let the engine run freely. This might be the case after a long stop. The powertrain clutch could be also engaged. In this case, the pressurized air in the tank will be used to propel the vehicle.

Experiment

FIG. 56 illustrates a test apparatus for verifying the semi-flexible valvetrain of the present invention. Some check valves and three-way valves are introduced to the system shown previously in FIG. 52. Solenoid valves 101, '2', '3' and '4' represent valves '2', 101, '4' and '3' of FIG. 50 respectively and are open for at least 140° of CAD to model the system during compression braking mode.

Figure 58:
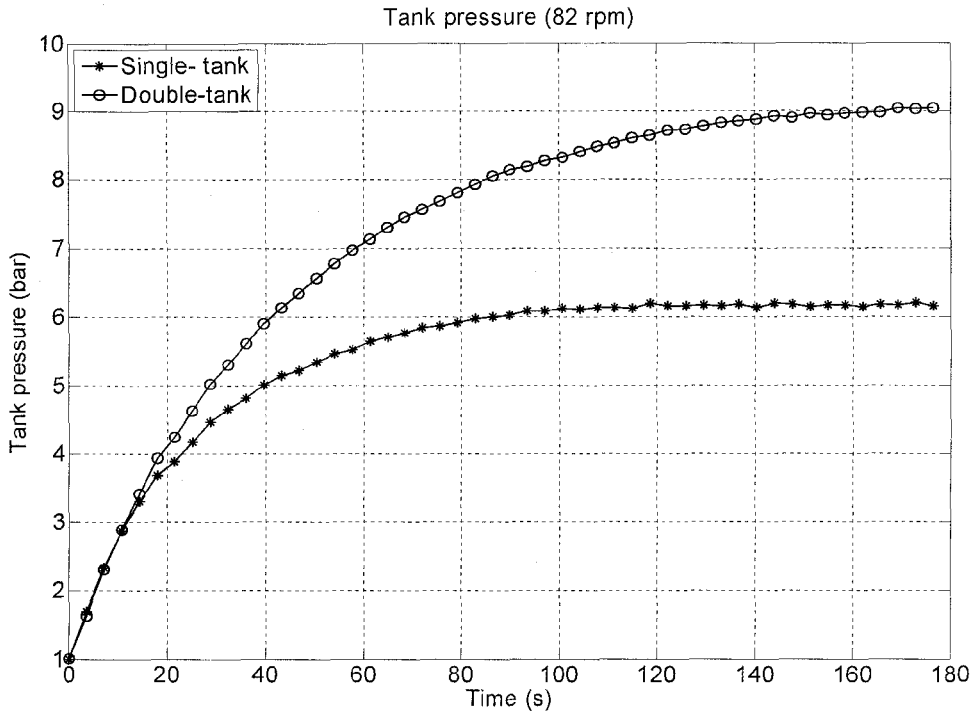
FIG. 58 illustrates the HP tank pressure after 180 s at an engine speed of 82 rpm.

The engine is run at 42 and 82 rpm and all the solenoid valves are open at least for about 140° of CAD according to FIG. 49. FIGS. 57 and 58 show the HP tank pressure after 180 s at engine speeds of 42 and 82 rpm. As can be seen, the combination of semi-flexible valvetrain, check valves and three-way valves can be utilized to implement the compression braking mode of an air hybrid engine. Furthermore, the experimental results show that double tank compression strategy results in higher tank pressure comparing to single tank compression strategy. As FIG. 58, the tank pressure goes up to more than 9 bar if the double tank compression algorithm is employed. However, the tank pressure goes up to only 6 bar if the single tank compression strategy is employed. This shows that the double tank compression strategy leads to at least 60% higher pressure comparing to the single tank algorithm.

Figure 59:
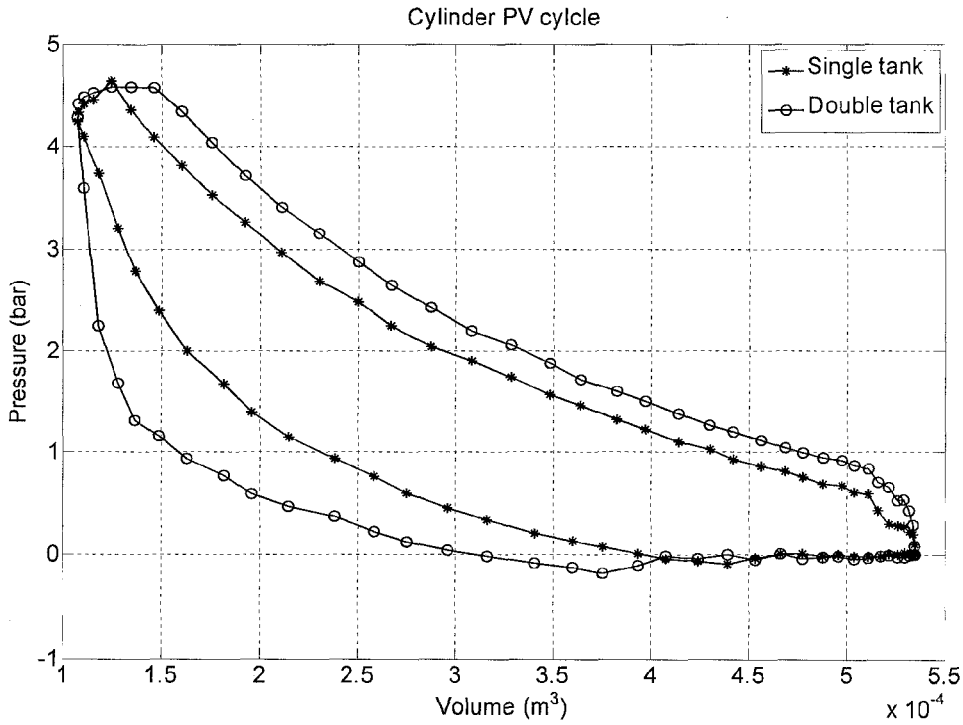
FIG. 59 shows the P-V diagram of the air in the cylinder.

FIG. 59 shows the P-V diagram of the air in the cylinder. As can be seen, employing the configuration shown in FIG. 49 enables the cylinder air cycle to be close to the ideal compression air cycle shown in FIGS. 8 and 23. In other words, introducing the check valves in the system avoids the blow down of air from the air tank to the cylinder or from the cylinder to the intake manifold. Thus, all the extra losses can be avoided by utilizing the configuration shown in FIG. 49. Using the proposed semi-flexible valvetrain, the necessity of using flexible valvetrain such as electro hydraulic or electromagnetic valvetrain is also avoided which reduces the complexity of an air hybrid engine significantly.

Other Applications, Driving Engine Accessories

It should be understood that the present invention has application in a number of areas other than improving vehicle energy consumption in a vehicle having an air hybrid engine.

For example, the air hybrid engine of the present invention may be coupled to a mechanical or electromagnetic clutch and an output shaft may be operatively linked to the vehicle's engine accessories in a series or parallel configuration. For example, the air hybrid engine may be coupled with an air motor to power engine accessories such as alternators, air-conditioning, water pump, etc Such applications may be advantageous especially where engine shut-off (stop-start) technology is utilized, so that use of electrical components and accessories in a vehicle can continue during times that an engine is not combusting, while using relatively less stored air than would be used if the air were driving the vehicle's motor. The latter may be advantageous to remove the linkage between a typical engine and an alternator, for example, for driving electrical components, so that the alternator is driven solely by the air storage tanks.

Of course, the generator could drive energy consuming devices, such as external electrical equipment in addition to the vehicle's electrical equipment and accessories, if desired.

Figure 60:
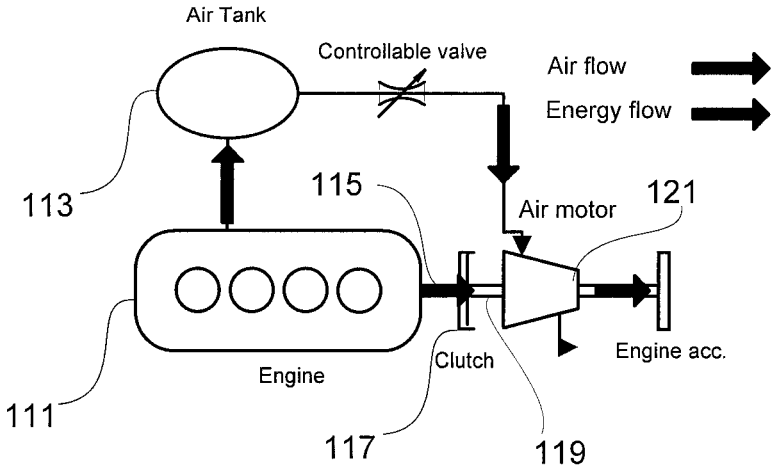
FIG. 60 illustrates a series configuration for powering electrical accessories.

FIG. 60 illustrates a series configuration for powering electrical accessories. An air hybrid engine 111 having an air tank 113 drives a shaft 115. The shaft 115 is coupled to an electromagnetic or mechanical clutch 117. The clutch 117 is also coupled to an engine accessory shaft 119 coaxial with the engine shaft. An air motor 121 can be driven by the air tank 113 and is operable to drive the engine accessory shaft 119. If the tank pressure is high enough to run the engine accessories, then the clutch 117 may be disengaged and the air motor 121 runs all or some of the engine accessories in air motor mode. If the tank pressure is not high enough, the clutch 117 may be engaged and the engine 111 may run all the accessories in combustion mode or air assist mode.

Figure 61:
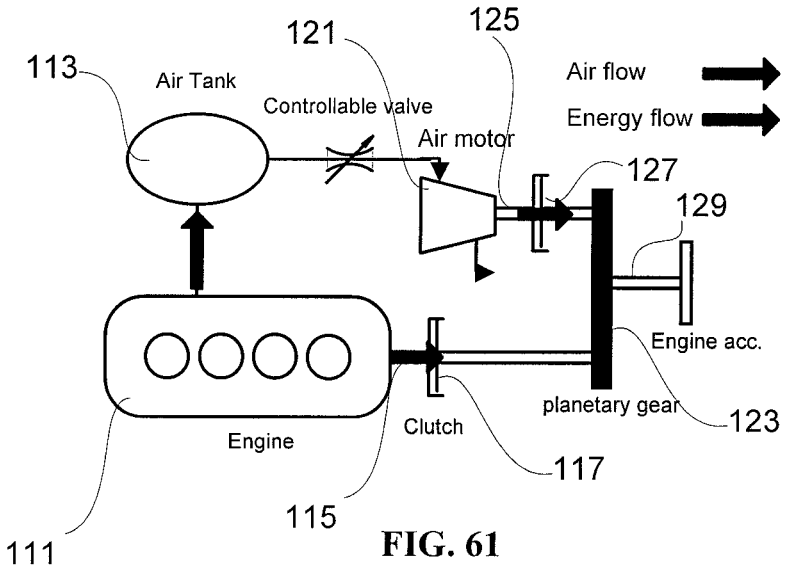
FIG. 61 illustrates a parallel configuration for powering electrical accessories.
Figure 62:
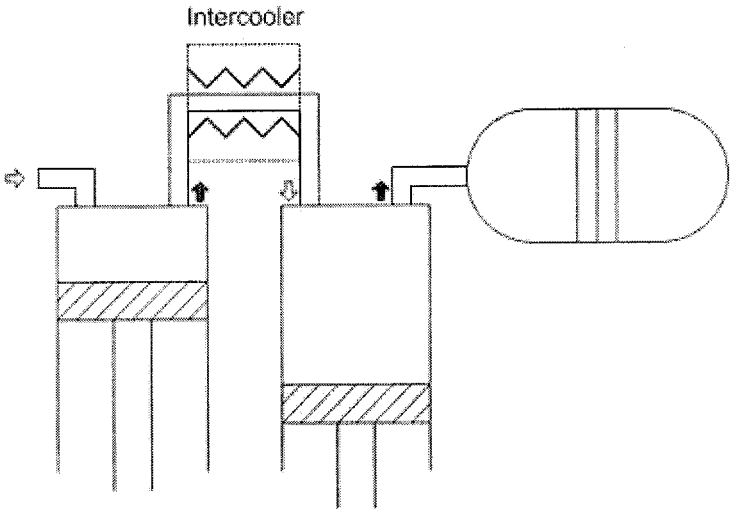
FIG. 62 illustrates a typical multistage compressor.
Figure 63:
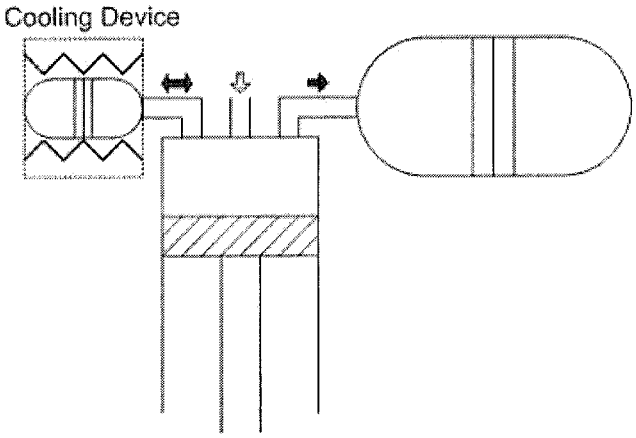
FIG. 63 illustrates a multi-tank compressor of the present invention, in one aspect thereof.

FIG. 61 illustrates a parallel configuration for powering electrical accessories. An air hybrid engine 111 having an air tank 113 drives an engine shaft 115. The engine shaft 115 is coupled to an electromagnetic or mechanical engine clutch 117. The engine clutch 117 enables the engine shaft 115 to selectively drive a planetary gear 123. An air motor 121 can be driven by the air tank 113 and is operable to drive an air motor shaft 125. The air motor shaft 125 is coupled to an air motor clutch 127. The air motor clutch 127 enables the air motor shaft 125 to selectively drive the planetary gear 123. A driving shaft 129 extends coaxially from the planetary gear 123 for driving engine accessories. If the tank pressure is high enough, the air motor clutch 127 is engaged and the engine clutch 117 is disengaged. Thus, the air motor 121 drives the planetary gear 123 and the driving shaft 129 to run all or some of the accessories. If the air tank pressure is not high enough, the air motor clutch 127 is disengaged, the engine clutch 117 is engaged and the engine drives the planetary gear 123 and the driving shaft 129 to run all the accessories

REFERENCES

[1] Micheal Schester, "New Cycle for Automobile Engines", SAE Technical Paper, Paper #1999-01-0623.

[2] C. Tai, T. C. Tsao, M. B. Levin, G. Barta, M. Schechter, "Using Camless Valvetrain for Air Hybrid Optimization", SAE Technical Paper, Paper #2003-01-0038

[3] Micheal Schester, "Regenerative Compression Braking-A Low Cost Alternative to Electric Hybrids", SAE Technical Paper, Paper #2000-01-1025.

[4] Y. Wang, T. Megli and M. Haghgooie, "Modeling and Control of Electromechanical Valve Actuator", SAE Technical Paper, Paper #2002-01-1106.

[5] C. Tai, A. Stubbs, T. Tsao, "Modeling and Controller Design of an Electromagnetic Engine Valve", Proceeding of the American Control Conference, Arlington, Va. Jun. 25-27, 2001.

[6] C. Tai, T. Tsao, "Control of an Electromechanical Camless Valve Actuator", Proceeding of the American Control Conference, Anchorage, Ak., May 8-10, 2002.

[7] C. Tai, A. Stubbs, T. Tsao, "Control of an Electromechanical Actuator for Camless Engines", Proceeding of the American Control Conference, Denver, Colo. Jun. 4-6, 2003.

[8] M. Montanari, F. Ronchi and C. Rossi, "Trajactory Generation for Camless Internal Combustion Engine Valve Control", Industrial Electronics, 2003. ISIE '03. 2003 IEEE International Symposium on. Publication Date: 9-11 Jun. 2003, page 454-459.

[9] Yimin Gao, and Mehrdad Ehsani, "Electronic braking system of EV and HEV—integration of regenerative braking, automatic braking force control and ABS," SAE 2001-01-2478

[10] Fazeli A., Khajepour A., Devaud C., Lashgarian N., "A New Air Hybrid Engine Using Throttle Control", SAE World Congress & Exhibition, Detroit, Mich., USA, 2009, Paper #2009-01-1319.

The invention claimed is:

1. A method of compressing air, the method characterized by: (a) adding air to a compressor at a first pressure from an air intake valve; (b) adding air to the compressor at a second pressure greater than the first pressure from a first air tank; (c) adiabatically compressing the air in the compressor; (d) transferring a portion of the compressed air to a second air tank; and (e) transferring the remaining portion of the compressed air to the first air tank.

2. The method of claim 1, characterized in that it comprises, between steps (b) and (c), the further steps of: successively adding air to the compressor, at successively higher pressures all greater than the second pressure, from one or more additional air tanks.

3. The method of claim 2, characterized in that it comprises, between steps (d) and (e), the further steps of: successively transferring portions of the remaining portion of the compressed air to the one or more additional air tanks.

4. The method of claim 1, characterized in that the compressor is a cylinder that includes a piston operable to compress air in the cylinder and the method occurs in a single piston stage.

5. The method of claim 4, characterized in that step (a) occurs substantially while the piston moves from top-dead-centre to bottom-dead-centre, step (b) occurs substantially while the piston is at bottom-dead-centre, steps (c) and (d) occur substantially while the piston moves from bottom-dead-centre to top-dead-centre, and step (e) occurs substantially while the piston is at top-dead-centre.

6. The method of claim 1, characterized in that the compressor is a Vane type rotary compressor having the air intake valve coupled to a relatively largest compartment, the second air tank coupled to a relatively smallest compartment, and the first air tank coupled to a first relatively mid-size compartment between the air intake valve and the second air tank along the compressor's rotation path and to a second relatively mid-size compartment between the second air tank and the air intake valve along the compressor's rotation path.

7. The method of claim 1, characterized in that it comprises the further step of powering a pneumatic device using at least some of the compressed air stored in the second air tank.

8. The method of claim 1, characterized in that it comprises the further step of powering an air motor using at least some of the compressed air stored in the second air tank.

9. The method of claim 1, characterized in that it comprises the further step of powering an air hybrid engine in start up, air assist, or air motor mode using at least some of the compressed air stored in the second air tank.

10. An air compression apparatus characterized by: an intake manifold; a low pressure air tank; a high pressure air tank; a plurality of cylinders, each cylinder having a piston, a first intake valve selectively enabling directional air flow between the intake manifold and the cylinder or from the cylinder to the high pressure air tank, a second intake valve selectively enabling air flow from the intake manifold to the cylinder or from the high pressure air tank to the cylinder, a first exhaust valve selectively enabling air flow between the exhaust manifold and the cylinder or from the cylinder to the low pressure air tank, and a second exhaust valve selectively enabling air flow from the low pressure air tank to the cylinder or between the exhaust manifold and the cylinder; and a cam shaft having a two stroke cam and a four stroke cam for each intake valve and exhaust valve; wherein the cam shaft is movable from a first position linking the two stroke cams to the intake valves and exhaust valves and a second position linking the four stroke cams to the intake valves and exhaust valves for selectively charging, discharging and storing air in the low pressure air tank and high pressure air tank.

11. The air compression apparatus of claim 10, characterized in that it further comprises an exhaust manifold.

12. The air compression apparatus of claim 11, characterized in that it provides an air hybrid engine operable to selectively charge the high pressure air tank to store compressed air and to selectively discharge the high pressure air tank to drive the plurality of cylinders.

13. The air compression apparatus of claim 11, characterized in that the apparatus is an air hybrid engine and further comprising: an engine accessory shaft linked to one or more energy consuming devices; a drive shaft driven by the air hybrid engine a clutch for selectively coupling the drive shaft to the engine accessory shaft; and an air motor coupled to the drive shaft, the air motor powered by compressed air stored in the high pressure air tank; wherein the clutch is disengaged when the air motor is operable to provide energy sufficient to energize the energy consuming devices and the clutch is engaged otherwise.

14. The air compression apparatus of claim 13, characterized in that the drive shaft and the air motor are coupled to the energy accessory shaft by a planetary gear.

15. The air compression apparatus of claim 10, characterized in that it further comprises a plurality of three-way valve for the selective enablement of air flow.

16. The air compression apparatus of claim 10, characterized in that it further comprises a plurality of directional air flow regulators for directional enablement of air flow.

17. The air compression apparatus of claim 16, characterized in that the directional air flow regulators are check valves.

18. The air compression apparatus of claim 10, characterized in that it further comprises a cam follower shaft disposed substantially parallel to the cam shaft and having a two stroke cam follower operably coupled to each two stroke cam and a four stroke cam follower operably coupled to each four stroke cam, and wherein the two stroke cam followers link the two stroke cams to the intake and exhaust valves and the four stroke cam followers link the four stroke cams to the intake and exhaust valves.

19. The air compression apparatus of claim 10, characterized in that air is selectively charged and discharged when the two stroke cams are linked to the intake and exhaust valves and the air is stored when the four stroke cams are linked to the intake and exhaust valves.

* * * * *